US010081114B2

(12) United States Patent
Sablatschan

(10) Patent No.: US 10,081,114 B2
(45) Date of Patent: Sep. 25, 2018

(54) BLADE SET, HAIR CUTTING APPLIANCE, AND RELATED MANUFACTURING METHOD

(71) Applicant: KONINKLIJKE PHILIPS N.V., Eindhoven (NL)

(72) Inventor: Siegfried Sablatschan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 154 days.

(21) Appl. No.: 15/301,509

(22) PCT Filed: Apr. 8, 2015

(86) PCT No.: PCT/EP2015/057535
§ 371 (c)(1),
(2) Date: Oct. 3, 2016

(87) PCT Pub. No.: WO2015/158571
PCT Pub. Date: Oct. 22, 2015

(65) Prior Publication Data

US 2017/0106548 A1 Apr. 20, 2017

(30) Foreign Application Priority Data

Apr. 18, 2014 (EP) ..... 14165284

(51) Int. Cl.
*B26B 19/38* (2006.01)
*B26B 19/06* (2006.01)

(52) U.S. Cl.
CPC ..... *B26B 19/3846* (2013.01); *B26B 19/063* (2013.01); *B26B 19/3893* (2013.01)

(58) Field of Classification Search
CPC ..... B26B 19/3846; B26B 19/3893
See application file for complete search history.

(56) References Cited

U.S. PATENT DOCUMENTS 2,102,529 A 12/1937 Hanley
2,290,326 A 7/1942 Hanley
(Continued)

FOREIGN PATENT DOCUMENTS

CN 2145688 Y 11/1993
DE 2455574 A1 7/1975
(Continued)

*Primary Examiner* — Sean Michalski

(57) ABSTRACT

The present disclosure relates to a hair cutting appliance (10), a blade set (20) for a hair cutting appliance (10), and to a stationary blade (22) for said blade set (20). Said stationary blade (22) may comprise a first wall portion (100) arranged to serve as a skin facing wall when in operation, a second wall portion (102) at least partially offset from the first wall portion (100), such that the first wall portion (100) and the second wall portion (102) define therebetween a guide slot (96) arranged to receive a movable cutter blade (24), at least one toothed leading edge (30) jointly formed by the first wall portion (100) and the second wall portion (102), wherein the at least one toothed leading edge (30) comprises a plurality of teeth (36), wherein the first wall portion (100) and the second wall portion (102) are connected at a frontal end of the at least one leading edge (30), thereby forming tips (86) of the teeth (36), wherein the stationary blade (22) is an integrally formed metal-plastic composite stationary blade (22), wherein the first wall portion (100) is at least partially made from metal material, and wherein the second wall portion (102) is at least partially made from plastic material. The disclosure further relates to a method for manufacturing a respective blade (22).

15 Claims, 11 Drawing Sheets

(56) References Cited

U.S. PATENT DOCUMENTS

| | | | | | |
|---|---|---|---|---|---|
| 2,948,063 | A | | 8/1960 | Ivar | |
| 3,279,061 | A | | 10/1966 | Andis | |
| 3,675,325 | A | | 7/1972 | Michelson | |
| 4,328,616 | A | * | 5/1982 | Andis | B26B 19/3846 30/216 |
| 4,459,334 | A | | 7/1984 | Blanpied | |
| 4,594,778 | A | * | 6/1986 | Dona | B26B 19/12 30/43.6 |
| 5,473,818 | A | | 12/1995 | Otsuka | |
| 5,579,581 | A | * | 12/1996 | Melton | B26B 19/063 30/223 |
| 5,600,890 | A | * | 2/1997 | Leitner | B26B 19/06 30/210 |
| 6,058,608 | A | | 5/2000 | Wruck | |
| 2009/0007442 | A1 | | 1/2009 | Kurihara | |
| 2011/0067244 | A1 | | 3/2011 | Eichhorn | |
| 2013/0008036 | A1 | | 10/2013 | Gringer | |
| 2015/0047203 | A1 | * | 2/2015 | Stapelbroek | B26B 19/06 30/43.6 |

FOREIGN PATENT DOCUMENTS

| | | | |
|---|---|---|---|
| GB | 2425277 | A | 10/2006 |
| WO | 0048795 | A1 | 8/2000 |
| WO | 2009024900 | A1 | 2/2009 |
| WO | 2009149662 | A1 | 12/2009 |
| WO | 2013150412 | A1 | 10/2013 |

* cited by examiner

BLADE SET, HAIR CUTTING APPLIANCE, AND RELATED MANUFACTURING METHOD

This application is the U.S. National Phase application under 35 U.S.C. § 371 of International Application No. PCT/EP2015/057535, filed on Apr. 8, 2015, which claims the benefit of International Application No. 14165284.2 filed on Apr. 18, 2014. These applications are hereby incorporated by reference herein.

FIELD OF THE INVENTION

The present disclosure relates to a hair cutting appliance, particularly to an electrically operated hair cutting appliance, and more particularly to a stationary blade of blade set for such an appliance. The blade set may be arranged to be moved through hair in a moving direction to cut hair. The stationary blade may be composed of a first wall portion and a second wall portion that define therebetween a guide slot, where a movable cutter blade may be at least partially encompassed and guided. The present disclosure further relates to a method for manufacturing a stationary blade and a blade set for a hair cutting appliance.

BACKGROUND OF THE INVENTION

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut by the relative cutting motion between the movable blade and the stationary blade.

However, there is still a need for improvement in hair cutting devices and respective blade sets. This may particularly involve user comfort related aspects, performance related aspects, and manufacturing related aspects. Manufacturing related aspects may involve suitability for series production or mass production.

SUMMARY OF THE INVENTION

It is an object of the present disclosure to provide an alternative stationary cutter blade, and a corresponding blade set that enables both shaving and trimming. In particular, a stationary blade and a blade set may be provided that contribute to a pleasant user experience in both shaving and trimming operations. More preferably, the present disclosure may address at least some drawbacks inherent in known prior art hair cutting blades as discussed above, for instance. It would be further advantageous to provide for a blade set that may exhibit an improved operating performance while preferably reducing the time required for cutting operations. It is further preferred to provide for a corresponding method for manufacturing such a stationary blade. It is particularly desired to present a manufacturing method that may permit the production of blade sets and particularly of stationary blades in a cost-efficient manner and with appropriate process capability.

According to a first aspect of the disclosure a stationary blade for a blade set of a hair cutting appliance is presented, said blade set being arranged to be moved through hair in a moving direction to cut hair, said stationary blade comprising:

a first wall portion arranged to serve as a skin facing wall when in operation, a second wall portion at least partially offset from the first wall portion, such that the first wall portion and the second wall portion define therebetween a guide slot arranged to receive a movable cutter blade, at least one toothed leading edge jointly formed by the first wall portion and the second wall portion, wherein the toothed leading edge comprises a plurality of teeth, wherein the first wall portion and the second wall portion are connected at a frontal end of the leading edge, thereby forming tips of the teeth, wherein the stationary blade is an integrally formed metal-plastic composite stationary blade, wherein the first wall portion is at least partially made from metal material, and wherein the second wall portion is at least partially made from plastic material.

This aspect is based on the insight that the first wall portion which may be in close contact with the skin, and which is basically configured to cooperate with a movable cutter blade to cut hair preferably exhibits considerable stiffness and robustness properties. The first wall portion is at least partially made from metal material, particularly from steel material such as stainless steel, for instance. Consequently, even though the first wall portion is preferably considerably thin-walled so as to allow cutting hairs close to the skin, it may provide adequate strength. Furthermore, the second wall portion may be added at the side typically facing away from the skin to further strengthen the stationary blade. Preferably, the stationary blade may be obtained from a combined manufacturing process which involves forming the plastic material and bonding the plastic material to the metal material, basically at the same time. It is particularly preferred that the stationary blade consists of the first wall portion and the second wall portion, i.e. no further essential components need to be mounted thereto to accomplish the stationary blade. Generally, the stationary blade may be regarded as a two-component part wherein the two components are integrally and fixedly interconnected.

In one embodiment, the stationary blade comprises a metal component, particularly a sheet metal insert, and a plastic component bonded to the metal component, wherein at least a central portion of the first wall portion is formed by the metal component. This may have the advantage that the metal component may be particularly thin which may allow cutting hairs very close to the skin of a user. Consequently, shaving performance may be improved.

In one embodiment, the metal component further comprises tooth stem portions comprising cutting edges that are configured to cooperate with cutting edges of respective teeth of the movable cutter blade to cut hairs that are trapped therebetween when in operation. Hence, cutting edges at the first wall portion may be formed at the metal component at the tooth stem portions thereof.

In one embodiment, the metal component comprises at least one anchoring element, particularly at least one positive-fit anchoring element extending from a respective tooth stem portion, wherein the plastic component and the metal component are connected at the at least one anchoring element. The at least one anchoring element may provide a locking geometry that may be engaged by or filled with the plastic material of the plastic component. Generally, the at least one anchoring element may longitudinally protrude from frontal ends of the tooth stem portions.

In one embodiment, the at least one anchoring element is inclined with respect to a top surface of the first wall portion, particularly rearwardly bended. In one embodiment, the at least one anchoring element is T-shaped, U-shaped or O-shaped, particularly when viewed from the top. In one embodiment, the at least one anchoring element is rearwardly offset from a top surface of the first wall portion. This may allow the plastic component to contact and cover a top side of the at least one anchoring element.

In one embodiment, the tips of the teeth are formed by the plastic component, wherein the plastic component further engages the positive-fit anchoring elements at a bonding area between the tooth stem portions of the metal component and the tips of the teeth. Consequently, the plastic component may be firmly bonded to the metal component and connected with the metal component in a form-fit or positive-fit manner at the same time.

In one embodiment, the plastic component and the metal component form an integrally formed part selected from the group consisting of insert-molded part, outsert-molded part and overmolded part. By way of example, the metal component may be provided as a metal insert component. The metal insert component may be arranged in a mold for the plastic component and at least sectionally overmolded with the plastic component.

In one embodiment, the teeth of the at least one toothed leading edge comprise, when viewed in a cross-sectional plane perpendicular to the lateral direction Y, a substantially U-shaped form comprising a first leg at the first wall portion and a second leg at the second wall portion, wherein the first leg and the second leg merge into one another at the tooth tips. Between the first leg and the second leg, a mounting gap or slot for the movable cutter blade may be provided, particularly for the teeth thereof.

According to a further aspect of the disclosure a blade set for a hair cutting appliance is presented, said blade set being arranged to be moved through hair in a moving direction to cut hair, said blade set comprising:

a stationary blade formed in accordance with at least some of the principles of the present disclosure, and a movable cutter blade comprising at least one toothed leading edge, said movable cutter blade being movably arranged within the guide slot defined by the stationary blade, such that, upon relative motion between the movable cutter blade and the stationary blade, the at least one toothed leading edge of the movable cutter blade cooperates with corresponding teeth of the stationary blade to enable cutting of hair caught therebetween in a cutting action.

It is particularly preferred that the blade set consists of the stationary blade and the movable cutter blade. This may involve a driving force transmitting member for the movable cutter blade. In other words, it is preferred in some embodiments that the blade set comprises no further element. However, it is particularly preferred that the movable cutter blade is arranged in the guide slot without being biased by a separate biasing member, such as a biasing spring element. Consequently, it is preferred that a top side of the movable cutter blade is in contact with the first wall portion and that a bottom side of the movable cutter blade is in contact with the second wall portion. It goes without saying that the movable cutter blade may be arranged in the guide slot with a certain clearance with respect to the first wall portion and the second wall portion, respectively, since the movable cutter blade is preferably slidably arranged at the guide slot.

Relative motion may involve reciprocating motion of the movable cutter blade with respect to the stationary blade. In some embodiments, relative motion may involve rotation of the movable blade with respect to the cutter blade.

According to yet another aspect of the disclosure a method of manufacturing a metal-plastic composite stationary blade of a blade set for a hair cutting appliance is presented, said method comprising the following steps:

providing a metal component, particularly a sheet metal component, at least substantially forming a central portion of a first wall portion, providing a mold, particularly an injection mold, the mold defining a shape of a plastic component, arranging the metal component in the mold, providing a substitute component in the mold, the substitute component being configured to keep clear a to-be-formed guide slot of the stationary blade when molding, forming, particularly injection molding, the plastic component, wherein the plastic component and the metal component define a first wall portion and a second wall portion of the stationary blade, the first wall portion being arranged to serve as a skin facing wall when in operation, the second wall portion being at least partially offset from the first wall portion, such that the first wall portion and the second wall portion define therebetween the guide slot for a movable cutter blade, wherein the first wall portion and the second wall portion jointly form at least one toothed leading edge comprising a plurality of teeth, and wherein the first wall portion and the second wall portion are connected at a frontal end of the leading edge, thereby forming tips of the teeth, and removing the substitute component from the metal-plastic composite stationary blade.

In one embodiment of the method, the step of providing the substitute component in the mold comprises at least one of the following steps:

providing at least one lateral slide in the mold that defines the guide slot for the movable cutter blade, and arranging a separate replacement dummy component in the mold, particularly a reusable dummy component, wherein the dummy component is removed from the metal-plastic composite stationary blade outside the mold.

In one embodiment, the method may further comprise:

machining the metal component, wherein machining the metal component comprises at least one of forming tooth stem portions and forming anchoring elements at the metal component, and wherein the step of machining the metal component further comprises at least one process selected from the group consisting of:

cutting, particularly laser cutting, etching, particularly electrochemical etching, stamping, coining, eroding, particularly wire-eroding, and combinations thereof.

The tooth stem portions may be arranged to cooperate with the teeth of the movable cutter blade to cut hair. The anchoring elements may be arranged to be engaged by the plastic component of the stationary blade for fixedly bonding the plastic component and the metal component.

According to still another aspect of the disclosure a method of manufacturing a blade set for a hair cutting appliance is presented, said method comprising the following steps:

manufacturing a stationary blade formed in accordance with at least some aspects of the present disclosure, providing a movable cutter blade comprising at least one toothed leading edge arranged to cooperate with at least one respective toothed leading edge of the stationary blade; and inserting the movable cutter blade into the guide slot of the stationary blade, particularly feeding the movable cutting blade through a lateral opening of the stationary blade.

Preferred embodiments of the invention are defined in the dependent claims. It shall be understood that the claimed method has similar and/or identical preferred embodiments as the claimed device and as defined in the dependent claims.

BRIEF DESCRIPTION OF THE DRAWINGS

Several aspects of the disclosure will be apparent from and elucidated with reference to the embodiments described hereinafter. In the following drawings

DETAILED DESCRIPTION OF THE INVENTION

Figure 1:
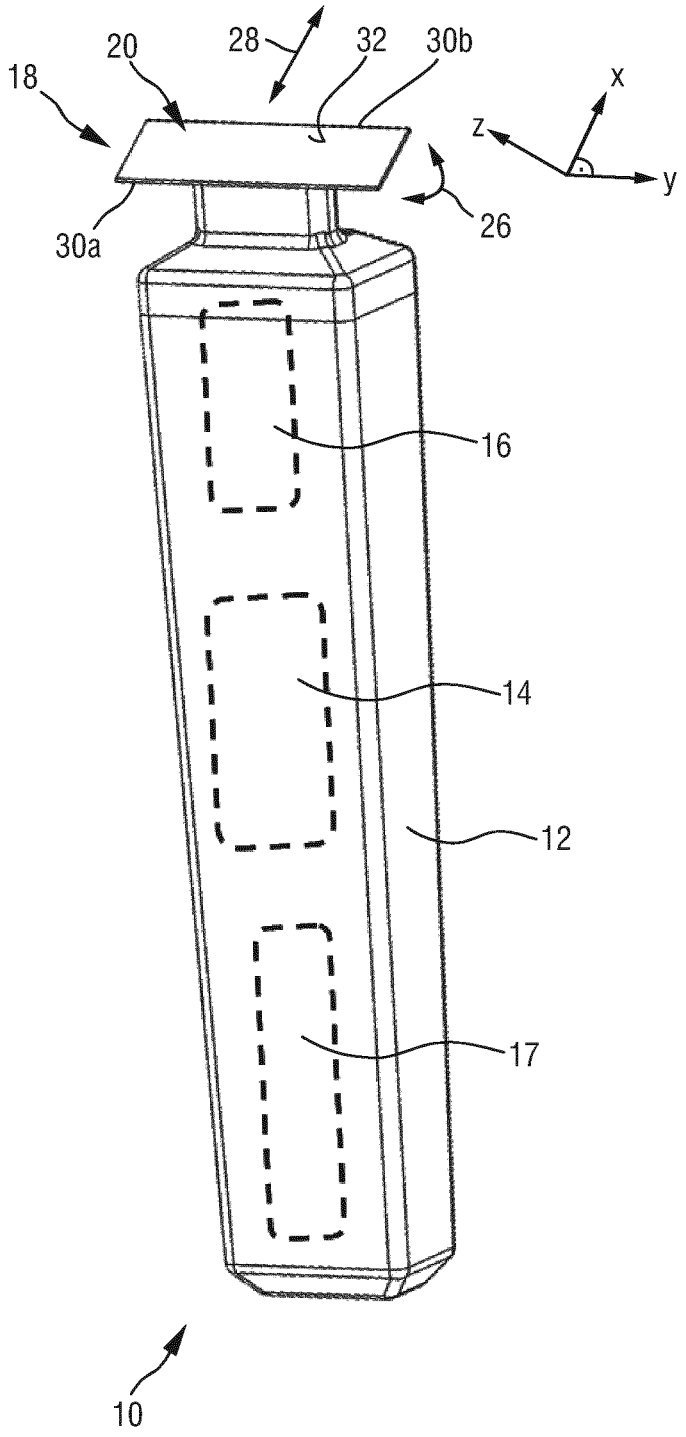
FIG. 1 shows a schematic perspective view of an exemplary electric hair cutting appliance fitted with an exemplary embodiment of a blade set in accordance with the present disclosure.

FIG. 1 schematically illustrates, in a simplified perspective view, an exemplary embodiment of a hair cutting appliance 10, particularly an electric hair cutting appliance 10. The cutting appliance 10 may comprise a housing 12, a motor indicated by a dashed block 14 in the housing 12, and a drive mechanism or drivetrain indicated by a dashed block 16 in a housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 17.

The cutting appliance 10 may further comprise a cutting head 18. At the cutting head 18, a blade set 20 may be attached to the hair cutting appliance 10. The blade set 20 may be driven by the motor 14 via the drive mechanism or drivetrain 16 to enable a cutting motion. The cutting motion may generally be regarded as a relative motion between a stationary blade 22 and a movable blade 24 which are shown and illustrated in more detail in FIG. 3, for instance, and will be described and discussed hereinafter. Generally, a user may grasp, hold and manually guide the cutting appliance 10 through hair in a moving direction 28 to cut hair. The cutting appliance 10 may be generally regarded as a hand-guided and hand-operated electrically powered device. Furthermore, the cutting head 18 or, more particularly, the blade set 20 can be connected to the housing 12 of the cutting appliance 10 in a pivotable manner, refer to the curved double-arrow indicated by reference numeral 26 in FIG. 1. In some embodiments, the cutting appliance 10 or, more specifically, the cutting head 18 including the blade set 20 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 18 comprising the blade set 20 is passed along a path at a desired distance relative to the skin.

When being guided moved through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference having a fixed definition and relation with respect to the orientation of the hair cutting appliance 10 and its cutting head 18 fitted with the blade set 20. That is, an overall orientation of the hair cutting appliance 10 with respect of the to-be-cut hair at the skin may be construed as somewhat unsteady. However, for illustrative purposes, it may be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is further worth mentioning that, for the purpose of the present disclosure, the coordinate system X-Y-Z is generally aligned with main directions and orientations of the cutting head 18 including the blade set 20.

Figure 2:
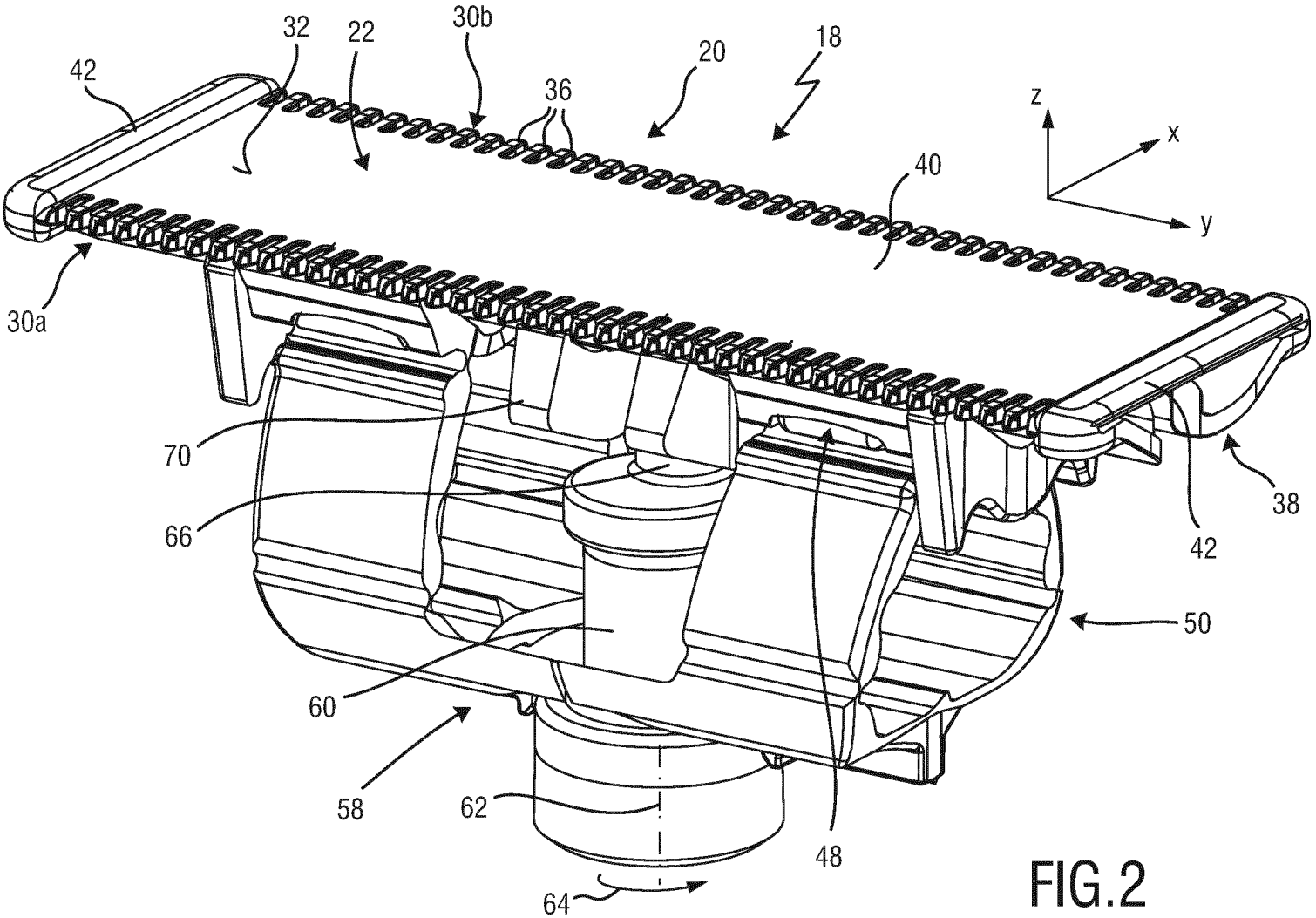
FIG. 2 shows a schematic top view of a cutting head comprising a blade set in accordance with the present disclosure, the cutting head being attached to a linkage mechanism.

FIG. 2 illustrates a perspective top view of an exemplary embodiment of the cutting head 18 that may be attached to the hair cutting appliance as shown in FIG. 1. The cutting head 18 is provided with the blade set 20 as already indicated above. The blade set 20 comprises a stationary blade 22 and a movable cutter blade 24 (hidden in FIG. 2). Further reference is made in this connection to the exploded view of the blade set 20 shown in FIG. 3. The stationary blade 22 and the movable cutter blade 24 are configured to be moved with respect to each other, thereby cutting hairs at their respective cutting edges.

The stationary blade 22 further comprises a top surface 32 which may be regarded as a skin-facing surface. Typically, when in operation as a shaving device, the hair cutting appliance 10 is oriented in such a way that the top surface 32 is basically parallel to or slightly inclined with respect to the skin. However, also alternative operation modes may be envisaged, where the top surface 32 is not necessarily parallel or, at least, substantially parallel to the skin. For instance, the hair cutting appliance 10 may be further used for beard styling or, more generally, hair styling. Hair styling may aim at the processing of considerably sharp edges or transitions between differently treated hair portions or beard portions of the user. By way of example, hair styling may involve precise shaping of sideburns or further distinct patches of facial hair. Consequently, when used in a styling mode, the top surface 32 and the currently to-be-treated skin portion are arranged at an angle, particularly substantially perpendicular to each other.

However, primarily for illustrative purposes, the top surface 32 and similarly oriented portions and components of the hair cutting appliance 10 may be regarded as skin-facing components and portions hereinafter. Consequently, elements and portions that are oriented in an opposite manner may be regarded as rearwardly oriented elements and portions or rather as elements and portions facing away from the skin hereinafter, for the purpose of disclosure.

As already indicated above, the stationary blade 22 may define at least one toothed leading edge 30. As shown in FIG. 2, the stationary blade 22 may define a first leading edge 30*a* and a second leading edge 30*b* that are offset from each other in the longitudinal direction X. The at least one toothed leading edge 30*a*, 30*b* may generally extend in the lateral direction Y. The top surface 32 may be regarded as a surface that is generally parallel to a plane defined by the longitudinal direction X and the lateral direction Y. At the at least one toothed leading edge 30, a plurality of teeth 36 of the stationary blade 22 may be provided. The teeth 36 may alternate with respective teeth slots. The teeth slots may define gaps between the teeth 36. Hairs may enter the gaps when the hair cutting appliance 10 is moved through hair in the moving direction 28 (FIG. 1).

The stationary blade 22 may be arranged as a metal-plastic composite component, for instance. In other words, the stationary blade 22 may be obtained from a multi-step manufacturing method that may include providing a metal component 40 (see also FIG. 3) and forming or, more precisely, molding a plastic component 38 including bonding the metal component 40 and the plastic component 38. This may particularly involve forming the stationary blade 22 by an insert-molding process, outsert-molding process or by an overmolding process. Generally, the stationary blade 22 may be regarded as a two-component stationary blade 22. However, since the stationary blade 22 is preferably formed by an integrated manufacturing process, basically no conventional assembly steps are required when forming the stationary blade 22. Rather, the integrated manufacturing process may include a net-shape manufacturing step or, at least, a near-net-shape manufacturing process. By way of example, molding the plastic component 38 which may also include bonding the plastic component 38 to the metal component 40 may readily define a near-net-shape or a net-shape configuration of the stationary blade 22. It is particularly preferred that the metal component 40 is made from sheet metal. It is particularly preferred that the plastic component 38 is made from injection-moldable plastic material.

Forming the stationary blade 22 from of different components, particularly integrally forming the stationary blade 22 may further have the advantage that portions thereof that have to endure high loads during operation may be formed from respective high-strength materials (e.g. metal materials) while portions thereof that are generally not exposed to huge loads when in operation may be formed from different materials which may significantly reduce manufacturing costs. Forming the stationary blade 22 as a plastic-metal composite part may further have the advantage that skin contact may be experienced by the user as being more comfortable. Particularly the plastic component 38 may exhibit a greatly reduced thermal conductivity when compared with the metal component 40. Consequently, heat emission sensed by the user when cutting hair may be reduced. In conventional hair cutting appliances, heat generation may be regarded as a huge barrier for improving the cutting performance. Heat generation basically limits the power and/or cutting speed of hair cutting appliances. By adding basically heat insulating materials (e.g. plastic materials) heat transfer from heat-generating spots (e.g. cutting edges) to the user's skin may be greatly reduced. This applies in particular at the tips of the teeth 36 of the stationary blade 22 which may be formed of plastic material.

Forming the stationary blade 22 as an integrally formed metal-plastic composite part may further have the advantage that further functions may be integrated in the design of the stationary blade 22. In other words, the stationary blade 22 may provide an enhanced functionality without the need of attaching or mounting additional components thereto.

By way of example, the plastic component 38 of the stationary blade 22 may be fitted with lateral protecting elements 42 which may also be regarded as so-called lateral side protectors. The lateral protecting elements 42 may cover lateral ends of the stationary blade 22, refer also to FIGS. 3 and 10. Consequently, direct skin contact at the relatively sharp lateral ends of the metal component 40 can be prevented. This may be particularly beneficial since the metal component 40 of the stationary blade 22 is relatively thin so as to allow to cut hairs close to the skin when shaving. However, at the same time, the relatively thin arrangement of the metal component 40 might cause skin irritation when sliding on the skin surface during shaving. Since particularly the skin-contacting portion of the metal component 40 may be actually so thin that relatively sharp edges may remain, the risk of skin irritations or even skin cuts may be the higher the thinner the metal component 40 and the stationary blade 22 actually is. It is therefore preferred, at least in some embodiments, to shield lateral sides of the metal component 40. The lateral protecting elements 42 may protrude from the top surface in the vertical direction or height direction Z. The at least one lateral protecting element 42 may be formed as an integrated part of the plastic component 38.

The stationary blade 22 may be further provided with mounting elements 48 that may enable a quick attachment to and a quick release from a linkage mechanism 50. The mounting elements 48 may be arranged at the plastic component 38, particularly integrally formed with the plastic component 38, refer also to FIGS. 3 and 10. The mounting elements 48 may comprise mounting protrusions, particularly snap-on mounting elements. The mounting elements 48 may be configured to cooperate with respective mounting elements at the linkage mechanism 50. It is particularly preferred that the blade set 20 can be attached to the linkage mechanism 50 without any further separate attachment member.

The linkage mechanism 50 (refer to FIG. 2) may connect the blade set 20 and the housing 12 of the hair cutting appliance 10. The linkage mechanism 50 may be configured such that the blade set 20 may swivel or pivot during operation when being guided through hair. The linkage mechanism 50 may provide the blade set 20 with a contour following capability. In some embodiments, the linkage mechanism 50 is arranged as a four-bar linkage mechanism. This may allow for a defined swiveling characteristic of the blade set 20. The linkage mechanism 50 may define a virtual pivot axis for the blade set 20.

FIG. 2 further illustrates an eccentric coupling mechanism 58. The eccentric coupling mechanism 58 may be regarded as a part of the drive mechanism or drivetrain 16 of the hair cutting appliance 10. The eccentric coupling mechanism 58 may be arranged to transform a rotational driving motion, refer to a curved arrow indicated by reference numeral 64 in FIG. 2, into a reciprocating motion of the movable blade 24 with respect to the stationary blade 22, refer also to FIG. 12 in this connection (double-arrow denoted by reference numeral 126). The eccentric coupling mechanism 58 may comprise a driveshaft 60 that is configured to be driven for rotation about an axis 62. At a front end of the driveshaft 60 facing the blade set 22 an eccentric portion 66 may be provided. The eccentric portion 66 may comprise a cylindrical portion which is offset from the (central) axis 62. Upon rotation of the driveshaft 60, the eccentric portion 66 may revolve around the axis 62. The eccentric portion 66 is arranged to engage a transmitting member 70 which may be attached to the movable blade 24.

Figure 3:
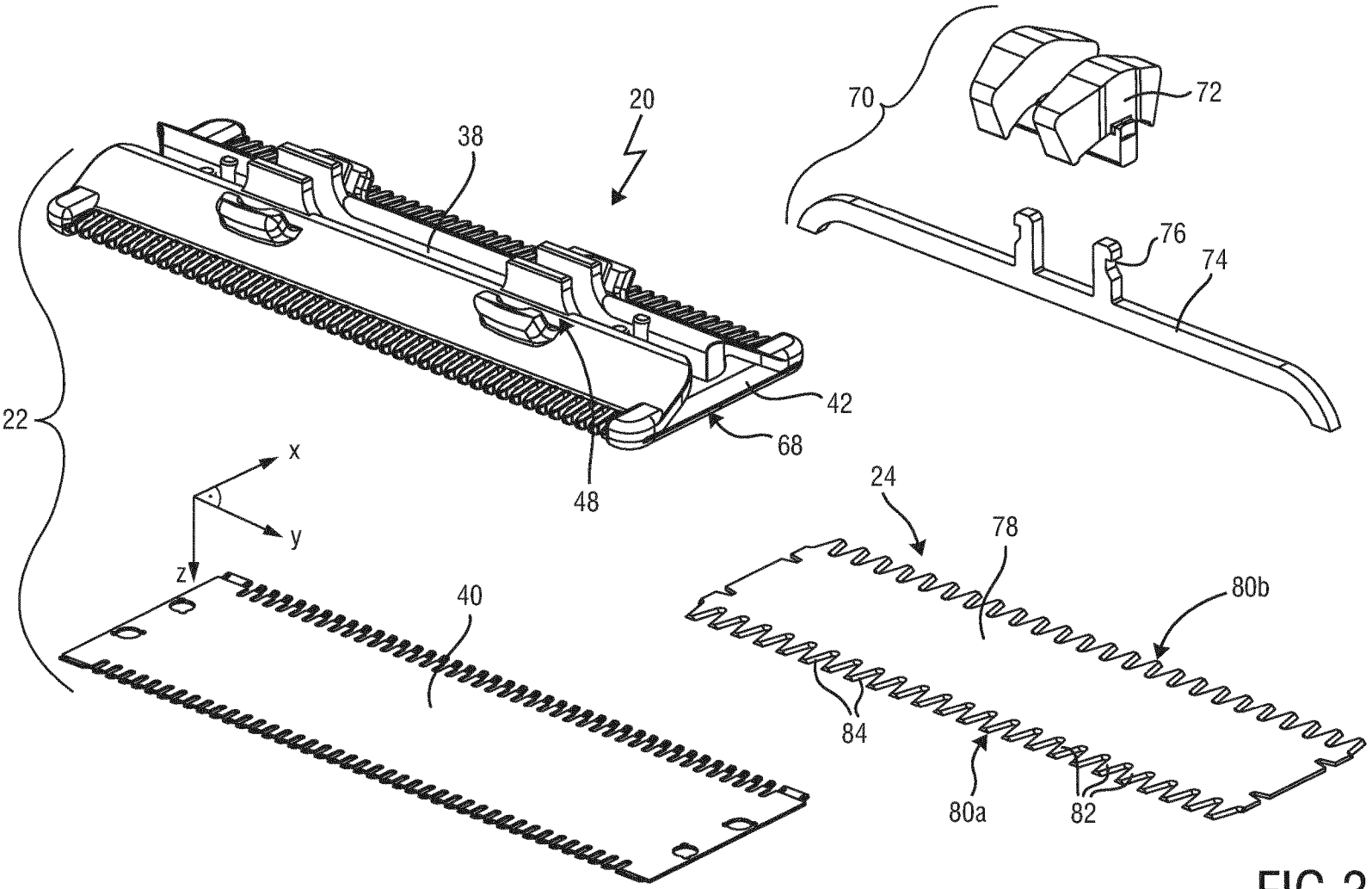
FIG. 3 is an exploded perspective bottom view of the blade set shown in FIG. 2.

With further reference to the exploded view shown in FIG. 3, the transmitting member 70 will be further detailed and described. The transmitting member 70 may comprise a reciprocating element 72 which may be configured to be engaged by the eccentric portion 66 of the driveshaft 60, refer also to FIG. 2. Consequently, the reciprocating element 72 may be reciprocatingly driven by the driveshaft 60. The transmitting member 70 may further comprise a connector bridge 74 which may be configured to contact the movable blade 24, particularly a main portion 78 thereof. By way of example, the connector bridge 74 may be bonded to the movable cutter blade 24. Bonding may involve soldering, welding and similar processes. However, at least in some embodiments, the connector bridge 74 or a similar connecting element of the transmitting member 70 may be rather attached to the movable cutter blade 24. As used herein, attaching may involve plugging in, pushing in, pressing in or similar mounting operations. The transmitting member 70 may further comprise a mounting element 76 which may be arranged at the connector bridge 74. At the mounting element 76, the reciprocating element 72 may be attached to the connector bridge 74. By way of example, the connector bridge 74 and the mounting element 76 may be arranged as a metal part. By way of example, the reciprocating element 72 may be arranged as a plastic part. For instance, the mounting element 76 may involve snap-on elements for fixing the reciprocating element 72 at the connector bridge 74. However, in the alternative, the mounting element 76 may be regarded as an anchoring element for the reciprocating element 72 when the latter one is firmly bonded to the connector bridge 74.

It is worth mentioning in this regard that the transmitting member 70 may be primarily arranged to transmit a lateral reciprocating driving motion to the movable cutter blade 24. However, the transmitting member 70 may be further arranged to serve as a loss prevention device for the movable cutter blade 24 at the blade set 20.

FIG. 3 further illustrates the plastic component 38 and the metal component 40 of the stationary blade 22 in an exploded state. It is worth mentioning in this connection that, since it is preferred that the stationary blade 22 is integrally formed, the plastic component 38 thereof typically does not exist as such in an isolated unique state. Rather, at least in some embodiments, forming the plastic component 38 may necessarily involve firmly bonding the plastic component 38 to the metal component 40.

The stationary blade 22 may comprise at least one lateral opening 68 through which the movable cutter blade 24 may be inserted. Consequently, the movable cutter blade may be inserted in the lateral direction Y. However, at least in some embodiments, the transmitting member 70 may be moved to the movable cutter blade 24 basically along the vertical direction Z. Mating the movable cutter blade 24 and the transmitting member 70 may therefore involve firstly inserting the movable cutter blade 24 through the lateral opening 68 of the stationary blade 22 and secondly, when the movable cutter blade 24 is arranged in the stationary blade 22, feeding or moving the transmitting member along the vertical direction Z to the stationary blade 22 so as to be connected to the movable cutter blade 24.

Generally, the movable cutter blade 24 may comprise at least one toothed leading edge 80 adjacent to the main portion 78. Particularly, the movable cutter blade 24 may comprise a first leading edge **80*a* and a second leading edge 80*b* that is longitudinally offset from the first leading edge 80*a*. At the at least one leading edge 80, a plurality of teeth 82 may be formed that are alternating with respective tooth slots. Each of the teeth 82 may be provided with respective cutting edges 84, particularly at their lateral flanks. The at least one toothed leading edge 80 of the movable cutter blade 24 may be arranged to cooperate with a respective toothed leading edge 30 of the stationary blade 22 when relative motion of the movable cutter blade 24 and the stationary blade 22 is induced. Consequently, the teeth 36 of the stationary blade 22 and the teeth 82 of the movable cutter blade 24** may cooperate to cut hair.

Figure 4:
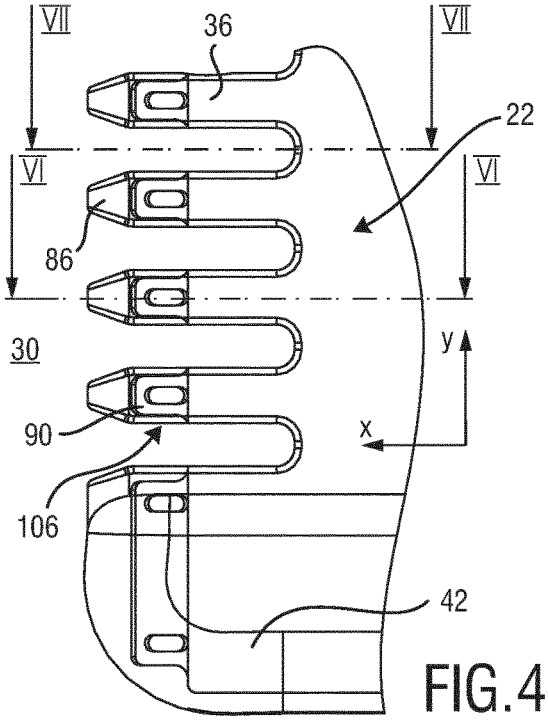
FIG. 4 is a partial top view of a stationary blade of the blade set shown in FIG. 2, wherein hidden edges of the stationary blade are shown for illustrated purposes.

With particular reference to FIGS. 4 to 9, the structure and configuration of an exemplary embodiment of the stationary blade 22 will be further detailed and illustrated. FIG. 4 is a partial top view of the stationary blade 22, wherein hidden portions of the metal component 40 (refer also to FIG. 5) are shown for illustrative purposes. At the teeth 36 of the stationary blade 22 tips 86 may be formed. The tips 86 may be primarily formed by the plastic component 38. However, substantial portions of the teeth 36 may be formed by the metal component 40. As can be best seen from FIG. 5, the metal component 40 may comprise so-called tooth stem portions 88 that may form a substantial portion of the teeth 36. The tooth stem portions 88 may be provided with respective cutting edges 94 that are configured to cooperate with cutting edges 84 of the teeth 82 of the movable cutter blade 24. At longitudinal ends of the tooth stem portions 88, anchoring elements 90 may be arranged. The anchoring elements 90 may be regarded as positive fit contact elements which may further strengthen the connection of the metal component 40 and the plastic component 38.

Figure 5:
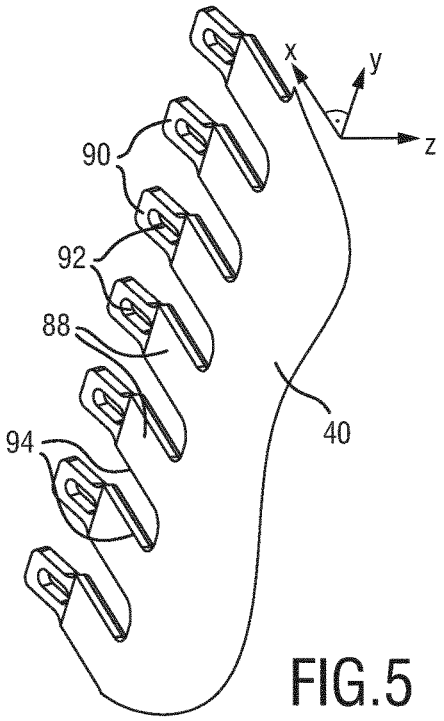
FIG. 5 is a partial perspective bottom view of a metal component of the stationary blade shown in FIG. 3.

By way of example, the anchoring elements 90 may be provided with undercuts or recess portions. Consequently, the anchoring elements 90 may be arranged as barbed anchoring elements. Preferably, a respective portion of the plastic component 38 that contacts the anchoring elements 90 may not be detached or released from the metal component 40 without being damaged or even destroyed. In other words, the plastic component 38 may be inextricably linked with the metal component 40. As shown in FIG. 5, the anchoring elements 90 may be provided with recesses or holes 92. The holes 92 may be arranged as slot holes, for instance. When molding the plastic component 38, plastic material may enter the holes 92. As can be best seen from FIGS. 6 and 8, the plastic material may fill the recesses or holes 92 of the anchoring elements 90 from both (vertical) sides, i.e. from the top side and the bottom side. Consequently, the anchoring elements 90 may be entirely covered by the plastic component 38. Adjacent to the anchoring elements 90, the tips 86 may be formed. Forming the tips 86 from the plastic component 38 may further have the advantage that the frontal end of the leading edge 30 is formed from a relatively soft material which may be further rounded or chamfered so as to soften edges. Consequently, contacting the user's skin with the frontal ends of the leading edge 30 is typically not experienced as causing skin irritation or similar adverse effects. Also high-temperature spots may be prevented at the tips 36 since the plastic component 38 is typically provided with a relatively low thermal conductivity coefficient, compared with the metal component 40.

Figure 8:
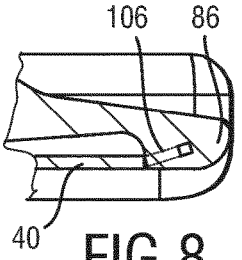
FIG. 8 is an enlarged detailed view of the stationary blade shown in FIG. 6 at a leading edge portion thereof.
Figure 6:
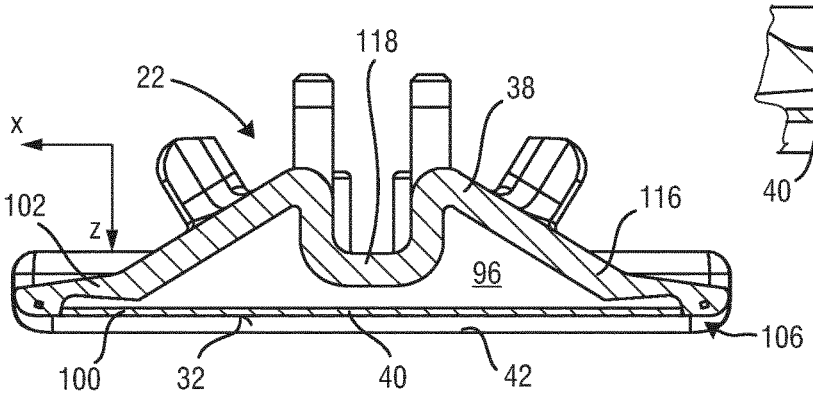
FIG. 6 is a cross-sectional view of the stationary blade shown in FIG. 4 taken along the line VI-VI in FIG. 4.
Figure 7:
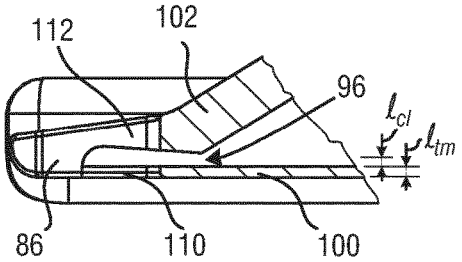
FIG. 7 is a partial cross-sectional side view of the stationary blade shown in FIG. 4 taken along the line VII-VII in FIG. 4.
Figure 9:
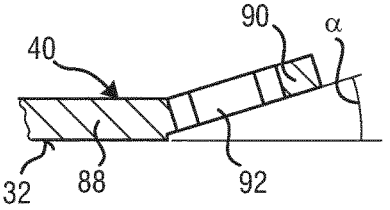
FIG. 9 is an enlarged detailed view of the metal component of the stationary blade basically corresponding to the view of FIG. 8.

As can be best seen from the cross-sectional views of FIGS. 6, 7 and 8, the edges of the tips 86 of the teeth 36 at the frontal ends of the leading edges 30 may be significantly rounded. As can be further seen, the transition between the metal component 40 and the plastic component 38 at the top surface 32 in the region of the teeth 36 may be substantially seamless or step-less. Further reference in this regard is made to FIG. 9. It may be advantageous to shape the anchoring elements 90 such that their top side (skin-facing side) is offset from the top surface 32. Consequently, also the skin-facing side of the anchoring elements 90 may be covered by the plastic component, refer also to FIG. 8. In one embodiment, the anchoring elements 90 may be inclined with respect to the top surface 32. The anchoring elements 90 may be arranged at an angle $\alpha$ (alpha) with respect to the tooth stem portions 88. It may be further preferred that the anchoring elements 90 are rearwardly bended with respect to the top surface 32. At least in some embodiments, the anchoring elements 90 may be thinner than the tooth stem portions 88. This may further enlarge the space which may be filled by the plastic component 38 when molding.

With further reference to FIG. 6, the stationary blade 22 will be further detailed and described. The stationary blade 22 may define and encompass a guide slot 96 for the movable cutter blade 24. To this end, the stationary blade 22 may comprise a first wall portion 100 and a second wall portion 102. For the purpose of this disclosure, the first wall portion 100 may be regarded as a skin-facing wall portion. This applies in particular when the blade set 20 is used for shaving. Consequently, the second wall portion 102 may be regarded as the wall portion facing away from the skin. In other words, the first wall portion 100 may be also referred to as top wall portion. The second wall portion 102 may also be referred to as bottom wall portion.

The first wall portion 100 and the second wall portion 102 may jointly define the teeth 36 of the stationary blade. The teeth 36 may comprise a slot or gap for the movable cutter blade 24, particularly for the teeth 82 thereof arranged at the at least one toothed leading edge 80. As indicated above, at least a substantial portion of the first wall portion 100 may be formed by the metal component 40. At least a substantial portion of the second wall portion 102 may be formed by the plastic component 38. At the exemplary embodiment illustrated in FIG. 6, the second wall portion 102 is entirely formed by the plastic component 38. Rather, the first wall portion 100 is jointly formed by the plastic component 38 and the metal component 40. This applies in particular at the leading edge 30. The first wall portion 100 may comprise, at the respective tooth portions thereof, bonding portions 106, where the plastic component 38 is bonded to the metal component 40. The bonding portions 106 may involve the anchoring elements 90 of the metal component 40 and the plastic material of the plastic component 38 covering the anchoring elements 90.

FIG. 6 and FIG. 8 illustrate a cross-section through a tooth 36, refer also to the line VIII-VIII in FIG. 4. By contrast, FIG. 7 illustrates a cross-section through a tooth slot, refer to line VII-VII in FIG. 4. As can be seen from FIG. 6 and FIG. 7, the first wall portion 100 and the second wall portion 102 may jointly form the leading edge 30 including the teeth 36. The first wall portion 100 and the second wall portion 102 may jointly define a basically U-shaped lateral cross-section of the respective teeth 36. The first wall portion 100 may define a first leg 110 of the U-shaped form. The second wall portion 102 may define a second leg of the U-shaped form. The first leg 110 and the second leg 112 may be connected at the tips 86 of the teeth 36. Between the first leg 110 and the second leg 112 a slot or gap for the movable cutter blade 24 may be provided.

As can be further seen from FIG. 6, the first wall portion 100 may be significantly thinner than the second wall portion 102 of the stationary blade 22. Consequently, at the skin-facing first wall portion 100, hair can be cut very close to the skin. It is therefore desirable to reduce the thickness of the first wall portion 100, particularly of the metal component 40. By way of example, the thickness $l_{tm}$ (refer to FIG. 7) of the metal component 40, particularly at the tooth stem portions 88, may be in the range of about 0.08 mm to 0.15 mm. Consequently, the first wall portion 100 as such may exhibit a considerably small strength and rigidity. It is therefore beneficial to back up or strengthen the first wall portion 100 by adding the second wall portion 102. Since the thickness of the second wall portion 102 basically does not influence the smallest achievable cutting length (e.g. the length of remaining hairs at the skin), the thickness of the second wall portion 102, particularly at the respective leading edges 30, may be significantly greater than the thickness $l_{tm}$ of the first wall portion 100, particularly of the metal component 40. This may provide the stationary blade 22 with sufficient strength and stability. As can be further seen from FIG. 6, the first wall portion 100 and the second wall portion 102 may basically form a closed profile, at least sectionally along their lateral extension, refer also to FIG. 10 and FIG. 11 in this connection. This may particularly apply when the stationary blade 22 is provided with a first and a second leading edge 30*a*, 30*b*. Consequently, the stiffness of the stationary blade 22, particularly the stiffness against bending stress or torsional stress may be further increased.

In one embodiment, the second wall portion 102 may comprise, adjacent to the second leg 112 at the respective leading edge 30, an inclined portion 116. Assuming that the stationary blade 22 is basically symmetrically shaped with respect to a central plane defined by the vertical direction Z and the lateral direction Y, the second wall portion 102 may further comprise a central portion 118 adjacent to the inclined portion 116. Consequently, the central portion 118 may be interposed between a first inclined portion 116 and a second inclined portion 116. The first inclined portion 116 may be positioned adjacent to a respective second leg 112 at a first leading edge 30*a*. The second inclined portion 116 may be positioned adjacent to a respective second leg at the second leading edge 30*b*. As can be best seen in FIG. 6, the second wall portion 102 may therefore comprise a basically M-shaped cross-section primarily defined by the inclined portions 116 and the central portion 118.

Figure 10:
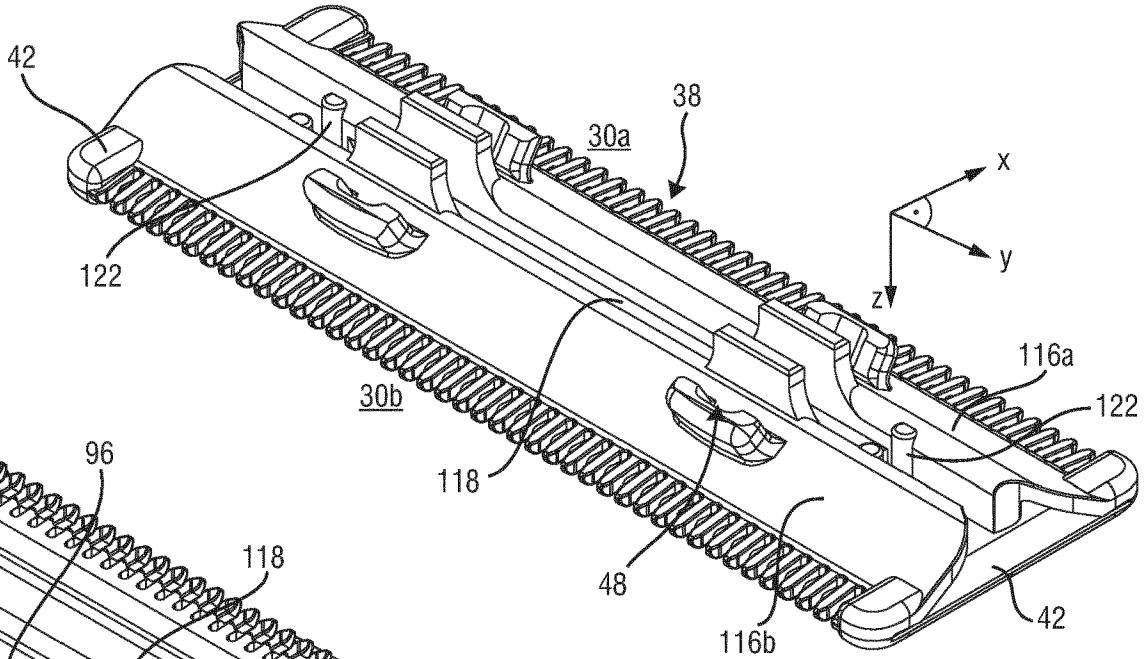
FIG. 10 is a perspective bottom view of a plastic component of the stationary blade shown in FIG. 2 and FIG. 3.
Figure 11:
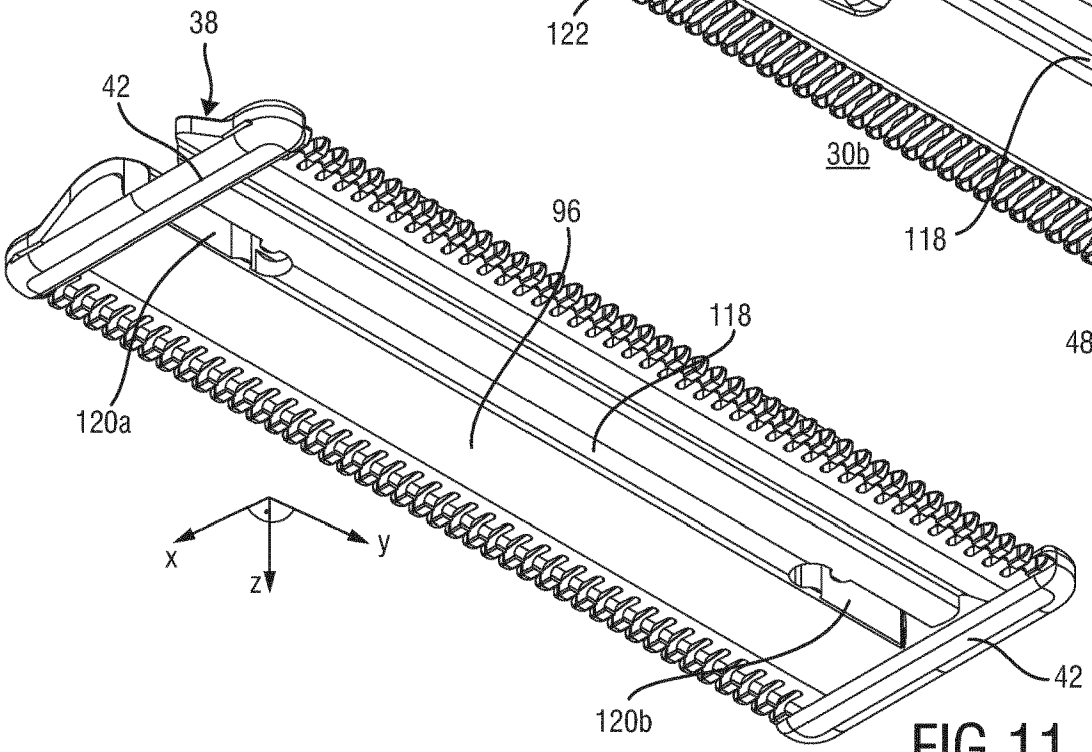
FIG. 11 is a perspective top view of the plastic component shown in FIG. 10.

With further reference to FIG. 10 and FIG. 11, the shape and configuration of an exemplary embodiment of the plastic component 38 of the stationary blade 22 is further detailed and described. As can be best seen in FIG. 10, the inclined portions 116*a*, 116*b* may basically extend for the whole (lateral) length of the plastic component 38. The leading edges 30*a*, 30*b* may generally extend between a first lateral protection element 42 and a second lateral protection element 42 that are arranged at opposite (lateral) ends of the plastic component 38. A recessed portion of the plastic component shown in FIG. 8 which basically defines a bottom side of the guide slot 96 is generally covered by the metal component 40, refer to FIG. 2.

As can be best seen from FIG. 11, the central portion 118 between the inclined portions 116*a*, 116*b* may generally extend for a substantial portion of the entire (lateral) length of the plastic component 38. However, alongside the central portion 118, at least one opening slot 120 may be provided. According to the exemplary embodiment shown in FIG. 10 and FIG. 11, the central portion 118 may be arranged between a first opening slot 120*a* and a second opening slot 120*b*. The opening slots 120*a*, 120*b* may define at least one opening through which, in the assembled state, the movable cutter blade 24 may be contacted by the transmitting member 70. As can be best seen in FIG. 10, the plastic component 38 may further comprise at least one guide element 122, particularly a plurality of guide elements 122 that may be configured to guide the connector bridge 74 and, consequently, the movable cutter blade 24 connected thereto. In one embodiment, the plurality of guide elements 122 may be arranged in pairs, wherein respective pairs are arranged at laterally offset ends of the central portion 118. The guide elements 122 may be arranged as basically vertically extending convexly shaped profiles. The guide elements 122 may define a longitudinal position of the transmitting member 70 and the movable cutter blade 24.

It is further worth mentioning in this regard that the central portion 118 and particularly the at least one opening slot 120 for the transmitting member 70 may be differently configured in alternative embodiments. By way of example, in one embodiment, the central portion 118 is interrupted by a single opening slot 120 through which the connector bridge 74 may contact the movable cutter blade 24. It is therefore emphasized that the connector bridge 74 of the transmitting member 70 does not necessarily have to comprise two contact spots for the movable cutter blade 24 that are considerably spaced from each other in the lateral direction Y, as can be seen in FIG. 3. Rather, the connector bridge 74 may also contact the movable cutter blade 24 at a (lateral) central portion.

Figure 12:
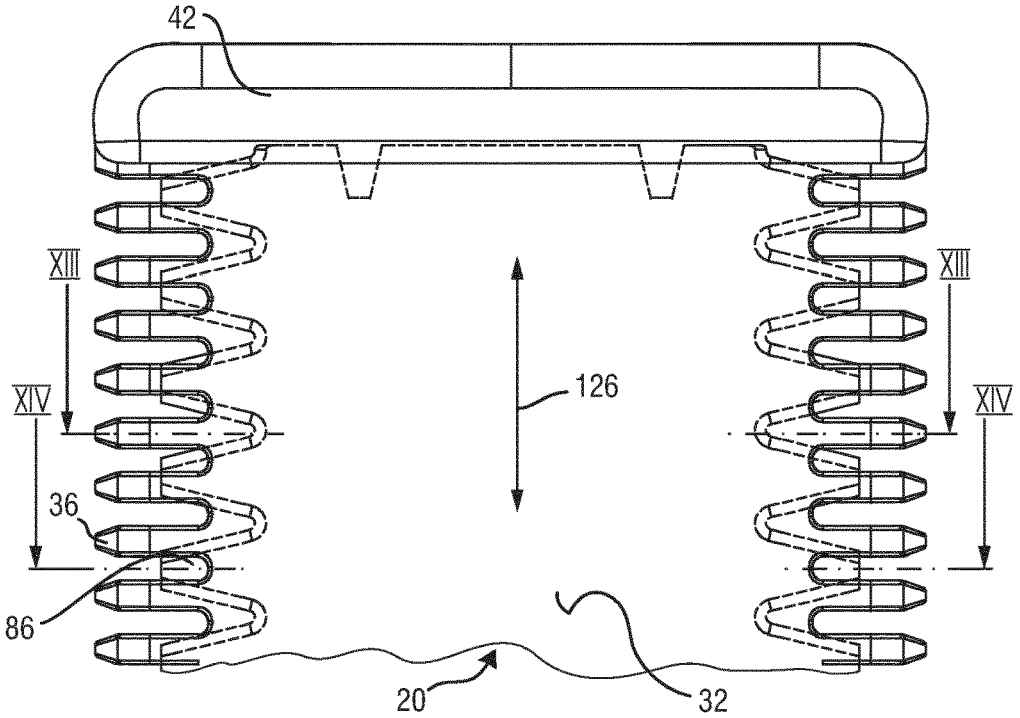
FIG. 12 is a partial top view of the blade set shown in FIG. 2 and FIG. 3, wherein hidden contours of a movable cutter blade thereof are indicated by dashed lines primarily for illustrative purposes.
Figure 13:
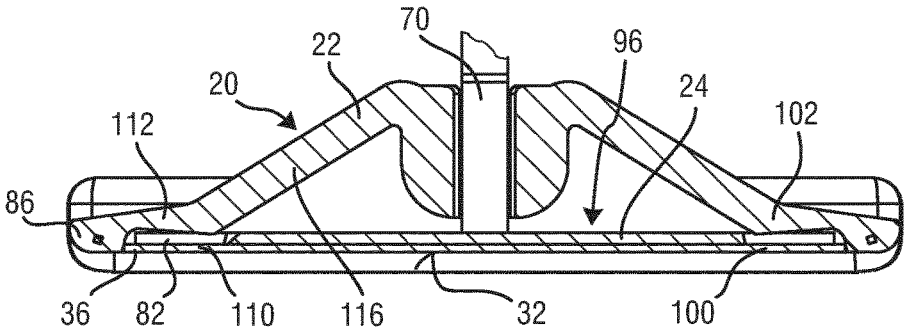
FIG. 13 is a cross-sectional side view of the blade set shown in FIG. 12 taken along the line XIII-XIII in FIG. 12.
Figure 14:
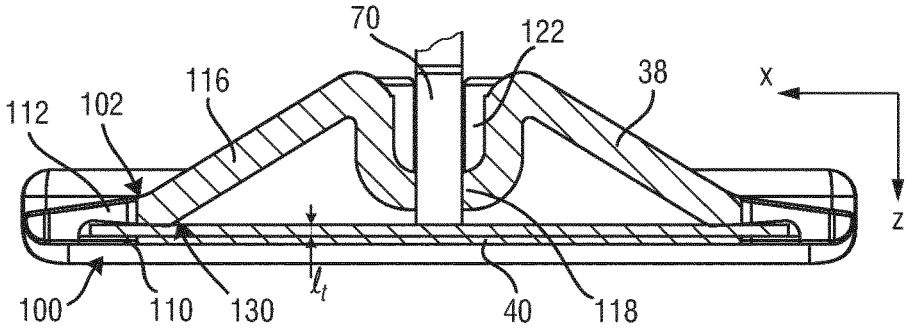
FIG. 14 is a further cross-sectional side view of the blade set shown in FIG. 12 taken along the line XIV-XIV in FIG. 12.

With particular reference to FIGS. 12, 13 and 14, the blade set 20 including the stationary blade 22 being fitted with the movable blade 24 is further detailed and described. FIG. 12 is a partial top view of the blade set 20, wherein hidden contours of the movable cutter blade 24 are indicated by dashed lines. FIG. 13 is a cross-sectional view of the arrangement shown in FIG. 12, wherein the section involves a tooth 36 at the stationary blade 22 and a tooth slot at the movable cutter blade 24, refer to the line XIII-XIII in FIG. 12. By contrast, the cross-sectional view shown in FIG. 14 includes a section through a tooth slot at the stationary blade 22 and a tooth 82 at the movable cutter blade 24, refer to line XIV-XIV in FIG. 12. The movable cutter blade 24 can be driven with respect to the stationary blade 22 in a reciprocating manner, refer to a double-arrow indicated by 126 in FIG. 12. Upon relative motion of the stationary blade 22 and the movable cutter blade 24, the respective teeth 36 and 82 may cooperate to cut hairs that enter the respective tooth slots.

The transmitting member 70 which is basically configured to transmit the driving motion to the movable cutter blade 24 may extend through the stationary blade 22, particularly through the at least one opening slot 120 associated with the central portion 118 of the stationary blade 22, refer to FIG. 11. FIG. 14 further shows a pair of guide elements 122 that may guide the transmitting member 70 and, consequently, the movable cutter blade 24. The guide elements 122 may define the longitudinal position of the transmitting member 70 and the movable cutter blade 24 at the stationary blade 22.

It is particularly preferred that, at least in some embodiments, the movable cutter blade 24 is arranged in the guide slot 96 in a defined manner. It may be further preferred that no further mounting member, particularly no biasing member is required for keeping the movable cutter blade 24 in its desired position and in close contact with the first wall portion 100. This may be achieved since the stationary blade 22 is provided with the first wall portion 100 and the second wall portion 102 opposite to the first wall portion 100. Both wall portions 100, 102 may define a precise mating slot for the movable cutter blade 24, particularly for the teeth 82 thereof, such that the vertical position (Z-position) of the movable cutter blade 24 may be defined at close tolerances. This may significantly reduce manufacturing and assembly costs of the blade set 20.

By way of example, the stationary blade 22 and the movable cutter blade 24 may be configured such that the movable cutter blade 24 at least sectionally contacts the first wall portion 100 in a substantially planar fashion. This may particularly apply to respective tooth portions. It is worth mentioning in this connection that such a configuration does not require perfect surface contact in practice when the blade set 20 is operated. By contrast, it may be assumed that the stationary blade 22 and/or the movable cutter blade 24 may be flexed or preloaded, at least when in operation, such that only small contact areas remain. However, the first wall portion 100 may serve at least as a defined limit stop for the movable cutter blade 24 in the (vertical) direction Z. The second wall portion 102 may comprise a protruding contact surface 130 which is associated with a respective toothed leading edge 30. The protruding contact surface 130 may be arranged at a transition between the second leg 112 and the inclined portion 116 of the second wall portion 102, refer to FIG. 14. The protruding contact surface 130 may define a resulting gap or height dimension at the guide slot 96 for the movable cutter blade 24. The resulting gap $l_{cl}$ (refer to FIG. 7) may be defined such that a defined clearance for the to-be-mounted movable cutter blade 24 is provided. Consequently, the movable cutter blade 24 may be arranged at the stationary blade 22 without significant preload, at least in an inactive state. However, in yet another embodiment, the gap or height dimension for the to-be-mounted cutter blade 24 in the slot 96 may be defined such that basically an interference fit is provided. Consequently, the movable cutter blade 24 may be at least slightly preloaded by the stationary blade 22. The height dimension or thickness dimension $l_t$ (refer to FIG. 14) of the movable cutter blade 24, at least at the at least one toothed leading edge 80 thereof, may be in the range of 0.1 mm to 0.18 mm.

Figure 15A:
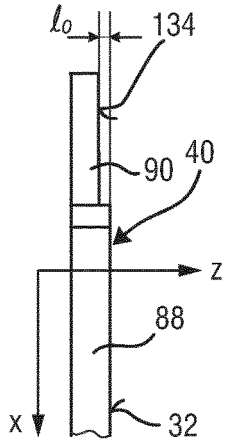
FIG. 15*a* is a side view of an exemplary anchoring element of a metal component of the stationary blade.
Figure 15B:
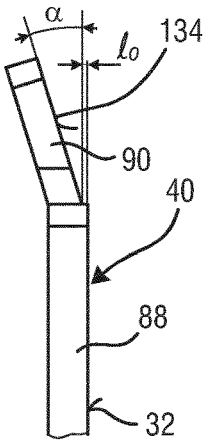
FIG. 15*b* is yet a further side view of another exemplary anchoring element of the metal component of the stationary blade in accordance with the embodiment shown in FIG. 9.
Figure 16:
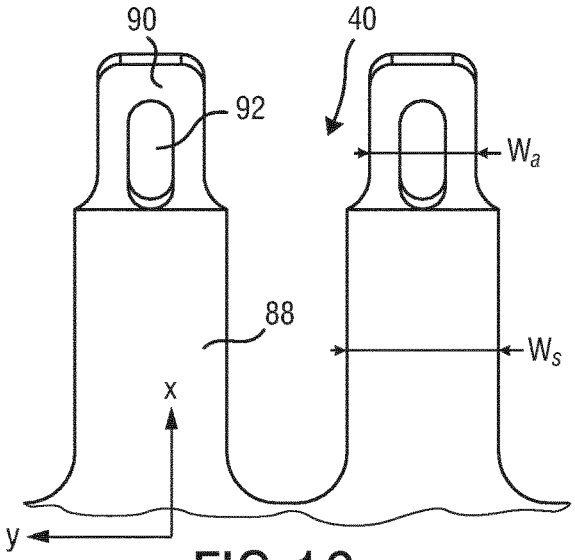
FIG. 16 shows a partial bottom view of exemplary tooth stem portions and anchoring elements of a metal component of the stationary blade in accordance with FIG. 9.
Figure 17:
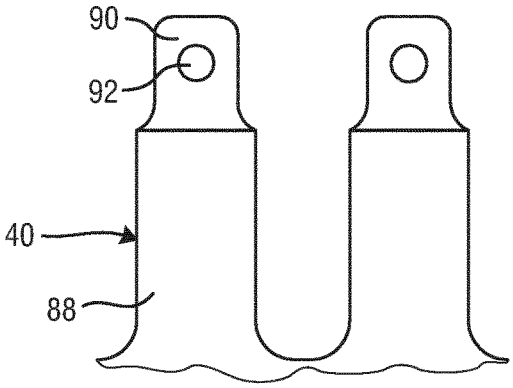
FIG. 17 shows yet another bottom view of exemplary tooth stem portions and anchoring elements of a metal component of a stationary blade.
Figure 18:
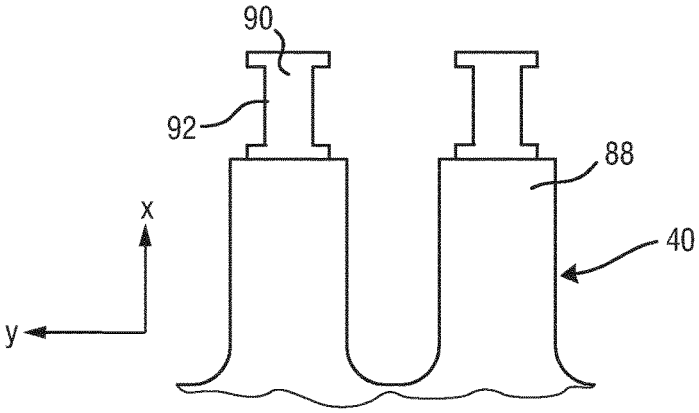
FIG. 18 shows still another embodiment of tooth stem portions and anchoring elements of a metal component of the stationary blade.

FIGS. 15*a* to 18 illustrate further advantageous alternative embodiments of metal components 40 that may serve at least as a substantial portion of the first wall portion 100. FIG. 15*a* and FIG. 15*b* show side views of exemplary tooth stem portions 88 from which anchoring elements 90 are extending. FIGS. 16 to 18 illustrate bottom views of exemplary tooth stem portions 88 from which respective anchoring elements 90 protrude. As already explained in connection with the embodiment of the stationary blade 22 illustrated in FIGS. 4 to 9, it may be advantageous to form the anchoring elements 90 such that the plastic component 38 of the stationary blade 22 may entirely cover the anchoring elements 90, i.e. the sides thereof that protrude from the tooth stem portions 88. Since it is further preferred that the top surface 32 (refer to FIG. 2) of the stationary blade 22 is basically planar or even or, more generally, comprises a smooth surface except for the lateral protection elements 42 (if any), it is advantageous to provide some space or offset a the top side 134 of the anchoring elements 90 such that the plastic material may also cover the top side 134 when molding. It is worth mentioning in this connection that the preferred planar or even shape of the top surface 32 does not necessarily exclude that, in practice, the first wall portion 100 and the top surface 32 thereof may be slightly curved or bended. By contrast, at least in some embodiments, it may be envisaged that the first wall portion 100 exhibits a slightly convex longitudinal extension.

FIG. 15*a* illustrates an embodiment of the stationary blade 40, wherein the anchoring element 90 is offset from the top surface 32, particularly offset in a substantially parallel manner. A resulting offset dimension $l_o$ is indicated in FIG. 15*a*. The offset dimension $l_o$ may be in the range of about 0.03 mm to about 0.1 mm, for instance. FIG. 15*b* illustrates a further alternative embodiment of anchoring elements 90 at tooth stem portions 88 of the metal component 40. As with the embodiment illustrated in FIG. 15*a*, the tooth stem portion 90 illustrated in FIG. 15*b* may be offset from the top surface 32 of the metal component 40. Furthermore, the anchoring element 90 may be inclined or bended with respect to the tooth stem portion 40. A vertical offset dimension is indicated in FIG. 15*b* by $l_o$. An inclination angle is indicated in FIG. 15*b* by α (alpha). By way of example, the offset dimension $l_o$ may be in the range of about 0.03 mm to 0.08 mm. The inclination angle α is preferably an acute angle. By way of example, the inclination angle α may be in the range of about 10° (degrees) to about 35° (degrees).

FIG. 16 illustrates a bottom view of tooth stem portions 88 including anchoring elements 90 that may be formed in accordance with the embodiment shown in FIG. 15*b*. The tooth stem portions 90 may comprise a lateral extension or width $w_s$ that is greater than a lateral extension or width $w_a$ of the anchoring elements 90. The extension $w_a$ may be selected such that the plastic material of the plastic component 38 may cover also (lateral) surfaces of the anchoring elements 90 without exceeding the width $w_s$ of the tooth stem portions 88. It is generally preferred that the anchoring elements 90 comprise some recessed features, particularly barbed features, so as to allow a tight coupling of the anchoring elements 90 and the plastic component 38. As already shown in FIG. 5, the anchoring elements 90 may be provided with holes, slots or, more particularly, with slot holes 92. Hence, plastic material may enter the respective recesses 92. Consequently, the metal component 40 and the plastic component 38 may be connected at the respective bonding portions in a firmly bonded and, additionally, in a form-fit manner. FIG. 17 and FIG. 18 illustrate further exemplary embodiments of anchoring elements 90 for tooth stem portions 88. By way of example, the anchoring elements 90 illustrated in FIGS. 17 and 18 may be formed in accordance with the embodiment shown in FIG. 15*a*. The anchoring element 90 of FIG. 17 may comprise recessed portions 92 formed as holes, particularly as cylindrical holes. The anchoring elements 90 illustrated in FIG. 18 may involve recessed portions 92 that are arranged as lateral recesses. Consequently, the anchoring elements 90 may involve a necking portion at their longitudinal extension. For instance, the anchoring elements 90 may basically comprise a H-shaped form (rotated by 90°).

It shall be understood that the exemplary embodiments illustrated in FIGS. 15 to 18 shall be primarily construed as beneficial exemplary executions provided for the sake of understanding. Therefore, various alternative embodiments of the anchoring elements 90 and their respective recessed portions 92 may be envisaged without departing from the scope of the present disclosure. It is generally preferred that the anchoring elements 90 are provided with form-fit elements so that the metal component 40 and the plastic component 38 may be connected as the anchoring elements in a bonded but also in a form-fit manner.

Figure 20:
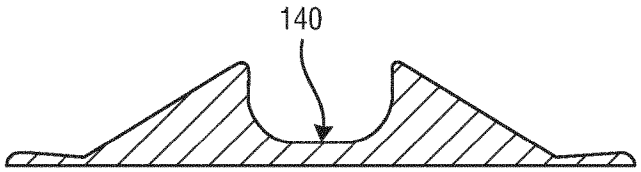
FIG. 20 illustrates a cross-section of a substitute component that is configured to form a guide slot at the stationary blade shown in FIG. 19.
Figure 19:
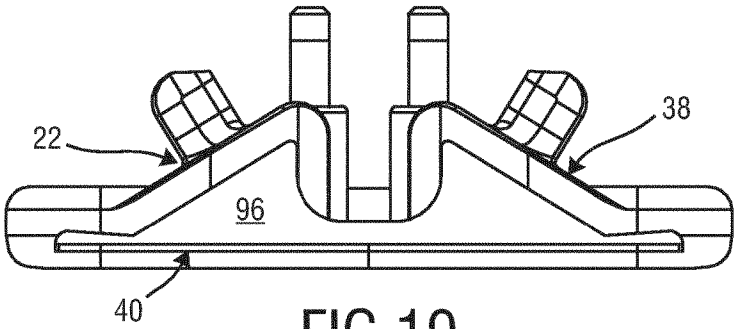
FIG. 19 shows a side view of the stationary blade shown in FIG. 2 and FIG. 3.
Figure 21:
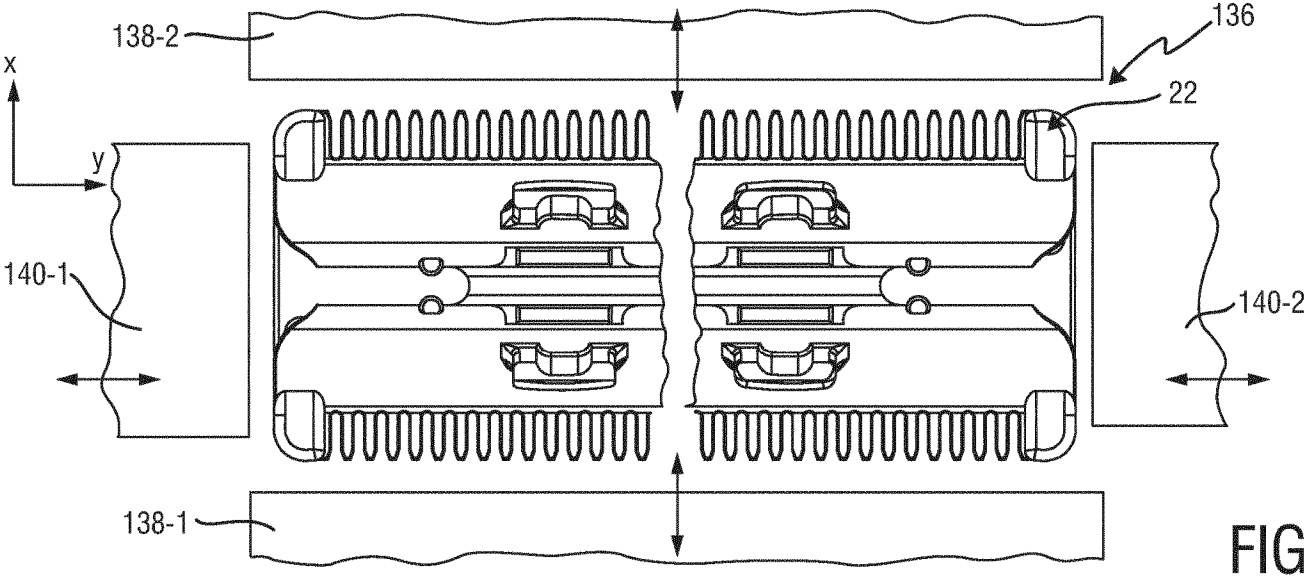
FIG. 21 is a broken bottom view of the stationary blade illustrated in FIG. 19, wherein mold halves and sliders of a mold for molding the stationary blade are indicated by partially shown blocks primarily for illustrative purposes.

With reference to FIGS. 19, 20 and 21, manufacturing-related aspects of the stationary blade 22 will be illustrated and further detailed. FIG. 19 is a side view of the stationary blade 22 including the plastic component 38 and the metal component 40. The plastic component 38 and the metal component 40 jointly defined a shell surrounding the guide slot 96 for the movable blade 24, refer also to FIG. 13 and FIG. 14. FIG. 20 illustrates a sectional area of the guide slot 96 for illustrative purposes. Manufacturing the stationary blade 22 may basically comprise inserting the metal component 40 into a mold, filling the space required for the guide slot 96 and molding the plastic component, particularly injection-molding the plastic component 38, thereby bonding the plastic component 38 to the metal component 40. The cavity that basically defines the guide slot 96 may be filled with a so-called substitute component 140, shaped in accordance with the section shown in FIG. 20. The substitute component 140 may also be regarded as a dummy component 140. The substitute component 140 may be inserted into the mold for the plastic component 38 and occupy the space of the guide slot 36. The substitute component 140 may generally be arranged as a re-usable substitute component or a non-substitute component which may also be referred to as lost substitute component.

Further reference is made to FIG. 21 comprising a broken bottom view of the stationary blade 22 and a schematic illustration of a mold 136 for the stationary blade 22. By way of example, the mold 136 for forming the stationary blade 22 may involve two (main) mold halves 138-1, 138-2 that are arranged to be moved to each other into close contact, thereby defining the molding cavity for the stationary blade 22, particularly for the plastic component 38 thereof. Refer also to respective arrows in FIG. 21 indicating the respective (longitudinal) motion of the mold halves 138-1, 138-2. In case the substitute component 140 is arranged as a re-usable component, the substitute component 140 may be embodied by at least one slide, particularly by at least one laterally movable slide 140-1, 140-2. By way of example, a first slide 140-1 and a second slide 140-2 may be arranged to be moved into the cavity defined by the mold halves 138-1, 138-2, thereby occupying the space that defines the guide slot 96. It goes without saying that alternative embodiments may be envisaged wherein a single slide 140 is used for forming the guide slot 96. The mold-halves 138-1, 138-2 and the slides 140-1, 140-2 may form components of the mold 136 that define the shape of the stationary blade 22. It goes without saying that the mold 136 may comprise further components, for instance further slides, etc. Further mold components may be required to form relatively complex integrated geometric features of the plastic component 38 of the stationary blade, refer to the mounting elements 48 in FIG. 3, for instance. Also even further components of the stationary blade 22, such as the guide elements 122 and the opening slots 120 may be formed by at least one additional slide.

It should be understood that the mold halves 138-1, 138-2 and the slides 140-1, 140-2 are illustrated in FIG. 21 in a rather simplified fashion primarily for illustrative purposes. A further detailed contour and shape of the mold halves 138-1, 138-2 and the slides 140-1, 140-2 can be derived from the illustrations and description of the outer shape and geometry of the stationary blade 22 provided herein.

In yet another exemplary embodiment, the substitute component 140 may be arranged as a component that is separate from the mold 136. In other words, the substitute component alternatingly may be arranged as an insert component that may be inserted into the cavity defined by the mold 136 along with the metal component 40. However, it is preferred that such an insert substitute component 140 is removable from the molded stationary blade 22 after molding, cooling down and removing the stationary blade 22 from the mold 136. Also in accordance with this embodiment, the substitute component 140 may be a re-usable substitute component.

In yet another embodiment, as already indicated above, the substitute component 140 may be arranged as a non-reusable component which may also be referred to as a so-called lost insert component. This may involve exemplary embodiments wherein the substitute component 140 needs to be damaged or destroyed in order to be removed from the stationary blade 22.

Figure 22:
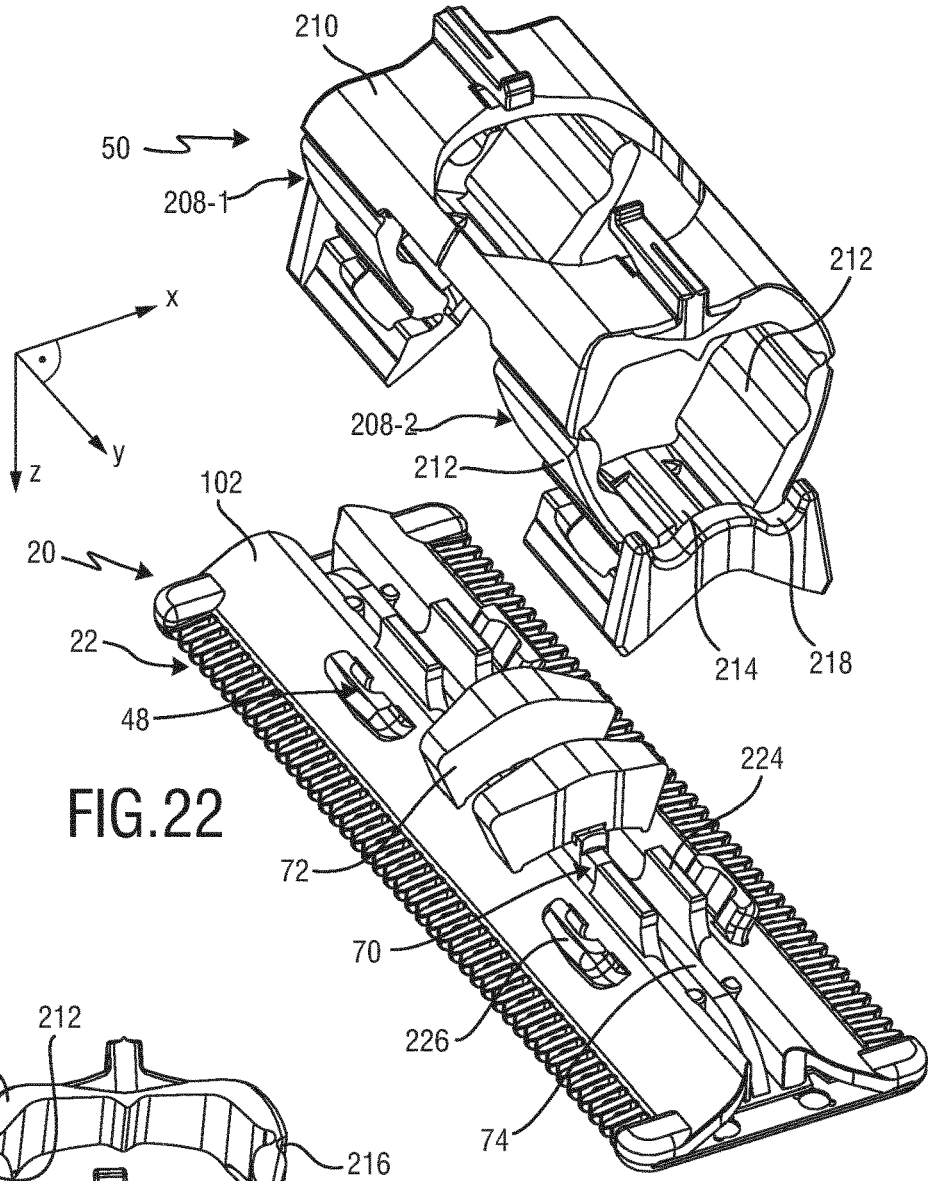
FIG. 22 is a perspective bottom view of an arrangement of the blade set and the linkage mechanism shown in FIG. 2, the blade set being detached from the linkage mechanism.

FIGS. 22 to 25 illustrate further beneficial embodiments of the blade set 20, particularly of the stationary blade 22 thereof. As already indicated above, at least a substantial portion of the stationary blade 22 may be formed by the plastic component 38. Further functions may be integrated into the stationary blade 22 without the need of adding or mounting further parts to the stationary blade 22. FIG. 22 illustrates a bottom perspective view of the blade set 20 including the stationary blade 22 and the movable blade 24 and the transmitting member 70 being mounted thereto. FIG. 22 further illustrates a linkage mechanism 50 to which the blade set 20 may be attached, refer also to FIG. 2. In FIG. 22, the blade set 20 is shown in a released or detached state.

As shown in FIG. 22, the linkage mechanism 50 may be arranged as a four-bar linkage mechanism. The linkage mechanism 50 may comprise at least one linkage element 208, particularly a first linkage element 208-1 and a second linkage element 208-2 that are laterally spaced from each other in the lateral direction Y. The at least one linkage element 208 may comprise a base 210 which may also be referred to as a contact element for connecting the linkage mechanism 50 and the housing 12 of the hair cutting appliance 10, refer also to FIG. 1. The linkage element 208 may further comprise a top portion or top 214 that is arranged opposite to the base 210. The linkage element 208 may further comprise coupling elements that connect a base 210 and a top 214. For instance, the linkage element 208 may comprise two coupling arms 212 each of which may be arranged between the base 210 and the top 214. The coupling arms 212 may be longitudinally spaced from each other in the longitudinal direction Y. The base 210 and the top 214 may be spaced from each other in the vertical or height direction Z. In one embodiment, the respective members of the linkage element 208 may be coupled to each other via film hinges 216. The film hinges 216 (refer also to FIG. 23) may provide neighboring members of the linkage element 208 with the capability of pivoting with respect to each other. Consequently, the blade set 20, while being attached to the linkage mechanism 50, may pivot or swivel with respect to the housing 12 of the hair cutting appliance about a virtual axis which is substantially parallel to the axis Y defining the lateral direction.

The stationary blade 22 may be provided with mounting elements 48, particularly at the second wall portion 102 thereof, such that the second wall portion 102 may contact the top 214 of the linkage element. Consequently, the blade set 20 and the top 214 may jointly swivel or pivot with respect to the base 210 of the at least one linkage element 208. At the top 214 of the linkage element 208, a limit stop arrangement 218 may be provided. The limit stop arrangement 218 may be configured to abut a corresponding limit stop element (not shown in FIG. 22) which is associated with the housing 12 of the hair cutting appliance 10.

Figure 23:
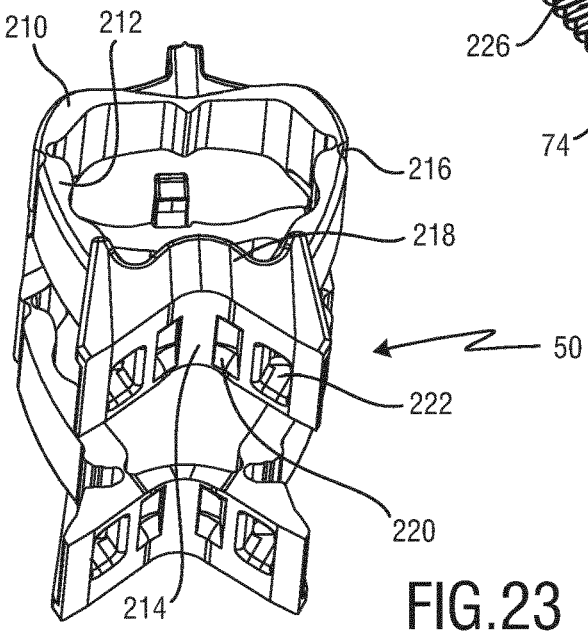
FIG. 23 illustrates a perspective top view of the linkage mechanism shown in FIG. 22, wherein mounting elements of the linkage mechanism are shown.
Figure 24:
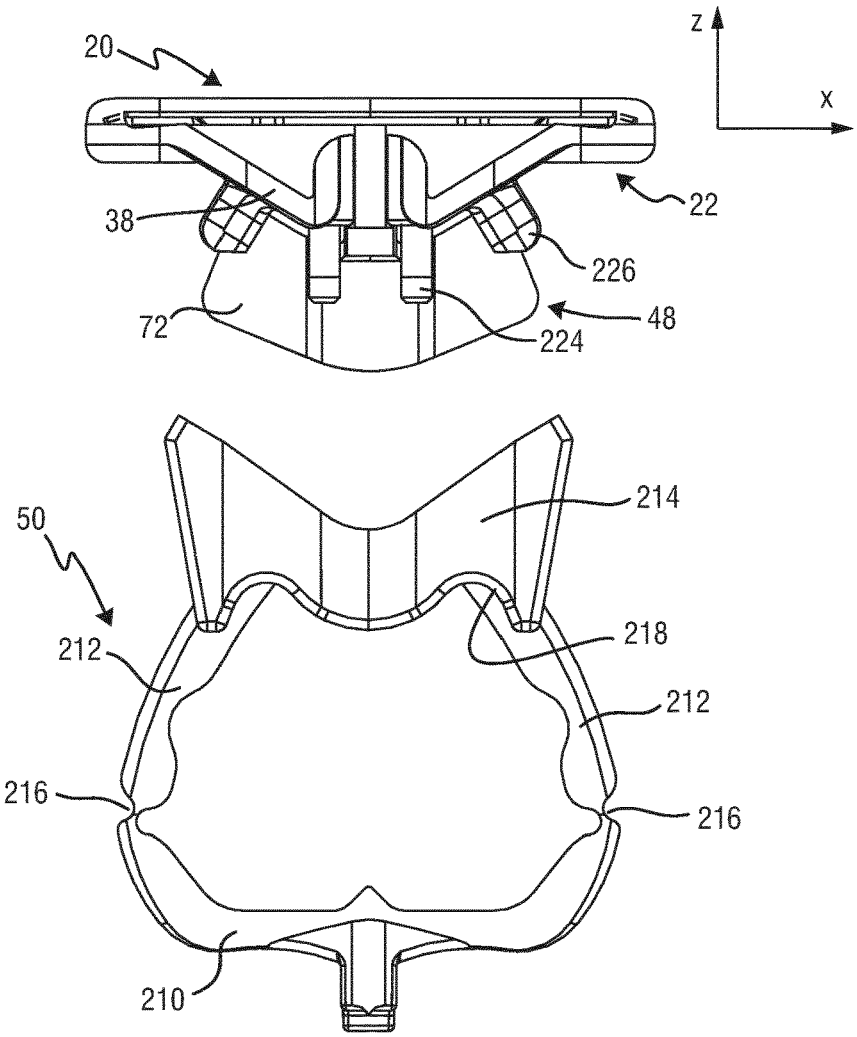
FIG. 24 is a side view of an arrangement of a blade set and a linkage mechanism in accordance with the embodiment shown in FIG. 22.
Figure 25:
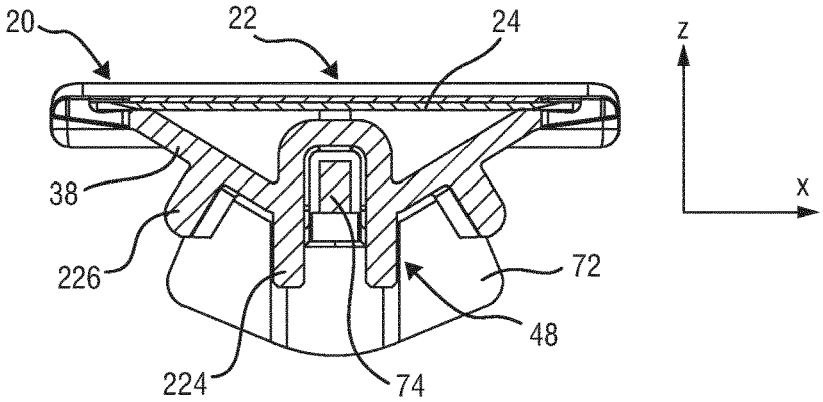
FIG. 25 is a cross-sectional side view of the blade set illustrating mounting elements integrally formed at the stationary blade.

FIG. 23 illustrates a perspective top view of the linkage mechanism 50. FIG. 24 illustrates a side view of the arrangement shown in FIG. 22, wherein the blade set 20 is detached from the linkage mechanism 50. FIG. 25 illustrates a cross-sectional side view of the blade set 20, wherein a section through the mounting elements 48 is illustrated. As can be best seen in FIGS. 22 and 25, the mounting elements 48 may comprise at least one guide protrusion 224 and at least one mounting protrusion 226 that may be configured to cooperate with at least one respective guide recess 220 and at least one respective mounting recess 222 at the top 214 of the linkage element 208 (refer to FIG. 23). As can be seen from FIG. 24, the blade set 20 may be basically vertically fed to the linkage mechanism 50 for attachment. Consequently, the at least one guide protrusion 224 and the at least one corresponding guide recess 220 may generally extend in the vertical direction (Z-direction). The at least one guide recess 220 and the at least one guide protrusion 224 may ensure that the blade set 20 assumes a desired orientation for attachment.

By contrast, the at least one mounting recess 222 and the at least one corresponding mounting protrusion 226 may be arranged for interference fitting or snap-on fitting. In some embodiments, the at least one mounting recess 222 and the at least one mounting protrusion 226 may be arranged as snap-on mounting elements. As can be best seen in FIG. 25, the at least one mounting protrusion 226 may at least partially or sectionally extend in the longitudinal direction X. Consequently, the at least one mounting protrusion 226 may engage the respective mounting recess 222 in a biasing manner or a snap-on manner. In other words, the at least one mounting protrusion 226 may be at least slightly preloaded when being mounted of in the engaged or attached state. Generally, the mounting protrusion 226 may be at least partially or sectionally inclined with respect to a plane defined by the lateral direction Y and the vertical direction Z (refer also to FIG. 22). Consequently, upon engaging the mounting recess 222, the mounting protrusion 226 may exert a retaining force comprising at least a longitudinal component that may prevent an undesired disengagement of the blade set 20 from the linkage mechanism 50.

As exemplarily shown in FIGS. 22 to 25, each of the linkage elements 208-1, 208-2 may be associated with a respective set of mounting elements 48. Each set of mounting elements 48 may comprise a pair of guide protrusions 224 and a pair of mounting protrusions 226 that may be arranged to cooperate with respective pairs of guide recesses 220 and mounting recesses 222 at each of the linkage elements 208-1, 208-2.

Figure 26:
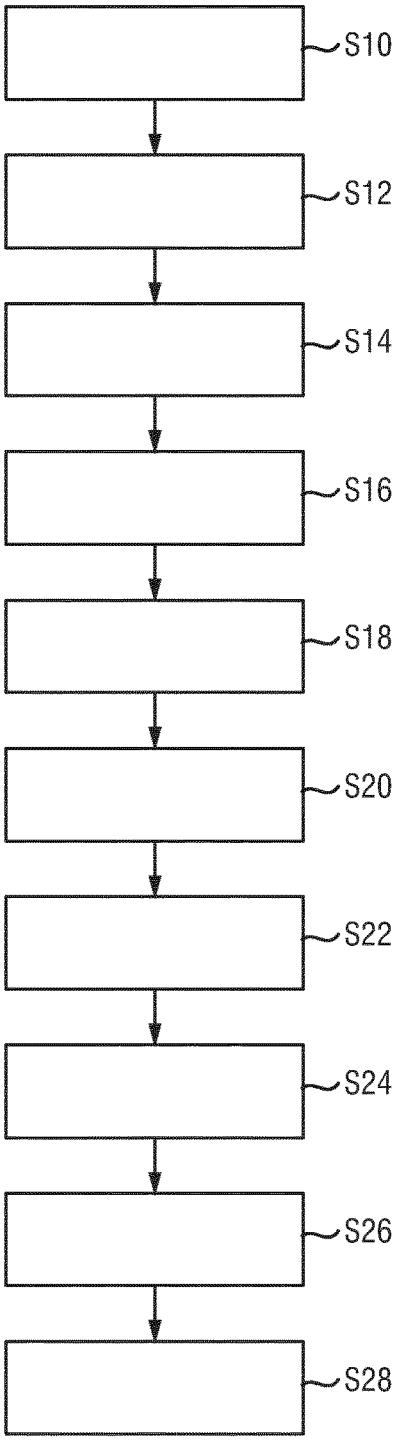
FIG. 26 shows an illustrative block diagram representing several steps of an embodiment of a method for manufacturing a stationary blade in accordance with several aspects of the present disclosure.

With reference to FIG. 26, an exemplary manufacturing method for a stationary blade 22 of a blade set 20 in accordance with several aspects of the present disclosure is illustrated and further detailed. At a first step S10 a raw material or semi-finished material for forming a metal component of the stationary blade may be provided. This may involve providing a sheet metal material. Providing a sheet metal material may further involve supplying the sheet metal material from a coil. A respective intermediate metal material may comprise a plurality of portions, each of which defining a to-be-finished metal component for the stationary blade. For instance, each of these defined precursor portions may be pre-processed by stamping or another adequate cutting method.

A further step S12 may follow which may include forming intermediate leading edges, particularly intermediate toothed leading edges of the to-be-processed metal components. By way of example, the step S12 may involve forming tooth stem portions at the leading edges. Forming the tooth stem portions may involve removing material between respective tooth stem portions so as to define slots therebetween. This may involve an adequate material-removing process, for instance stamping, laser cutting, wire cutting or, more preferably, etching. Further material-removing processes may be envisaged. Forming tooth stem portions at respective leading edges of the metal components may further involve forming considerably sharp cutting edges at the tooth stem portions, particularly at lateral flanks thereof. Etching the tooth stem portions may involve processing a general form of the tooth stem portions and further creating relatively sharp cutting edges at their flanks.

A further step S14 may follow which may include forming or processing anchoring portions. Preferably, the anchoring portions extend from longitudinal ends of the tooth stem portions at the leading edges. The anchoring portions preferably include recesses or similar elements that may be engaged by and filled with a moldable material. It is further preferred that the anchoring portions at the tooth stem portions are further machined at skin-facing and lateral sides thereof (refer also to FIG. 5 and to FIGS. 15 to 18) such that they may be covered by the molded or moldable component resulting in a generally smooth surface without significant steps at a transition between the anchoring portions and the tooth stem portions. It goes without saying that the steps S14 and S12 may be combined. For instance, the steps S12 and S14 may be implemented by an integrated etching step.

At a further step S16, which may be regarded as an optional step, the anchoring elements or anchoring portions may be bended with respect to the tooth stem portions. Bending the anchoring portions may further strengthen the fixation of the molded material and the metal component since more space may be provided for the plastic material. There may be at least some embodiments of the manufacturing method which do not require the step S16.

A further optional step S18 may follow which may include separating a plurality of precursors for the metal component from a respective row or array at the supplied metal material, particularly at the supplied sheet metal material, for instance at the supplied sheet metal coil. The step S18 may involve cutting or stamping respective precursors from a respective supporting structure. It is worth mentioning in this regard that the separating step S18 alternatively might also take place at another stage of the manufacturing process illustrated in FIG. 26. It may be regarded as a matter of choice to separate the metal component precursors at an early stage or a relatively late stag of the manufacturing process. Consequently, in some embodiments the metal component of the stationary blade may be at least substantially finished at the step S16 or the step S18, for instance.

A further step S20 may follow which may involve placing the metal component in a cavity of a molding tool. Placing the metal component may include placing the metal component in a defined orientation in the cavity of the mold. As already indicated above, the metal component may be placed in the mold cavity in its separated state. However, at least in some embodiments, placing a plurality of metal components in a mold comprising a respective plurality of cavities may be envisaged. The respective metal components of the plurality of metal components may be separated from each other. However, in the alternative, the metal components may be attached to a common supporting structure.

Having placed the metal component in the cavity of the mold, placing a substitute component in the mold may follow. The substitute component may cover or fill a space in the mold cavity to define a guide slot in the to-be-formed stationary blade. Placing the substitute component in the mold may include placing a re-usable or a non-re-usable substitute component in the mold. By way of example, the step S22 may include inserting at least one slide into the cavity of the mold. The at least one slide may be arranged as a component of the molding tool. For instance, the molding tool may be provided with two opposite slides that form the substitute component.

A further step S24 may follow which may be regarded as molding step. At the molding step S24 a molded or moldable material may be injected into the cavity of the mold. The step S24 may also be referred to as injection-molding step. The step S24 may involve injecting a melted plastic material into the mold cavity. Consequently, the cavity in the mold may be filled with the basically fluid plastic material. The plastic material may define a plastic component of the to-be-formed stationary blade. The plastic component may be bonded to the metal component, particularly to anchoring elements or anchoring portions thereof. Connecting the metal component and the plastic component may further involve engaging recessed portions at the anchoring portions with the molded plastic material. Generally, the step S24 may create an integrally formed metal-plastic composite stationary blade. Particularly, the step S24 may be referred to as insert-molding step. The metal component may therefore be regarded as the insert component. In some embodiments, the step S24 may be regarded as an outsert-molding step. In yet some further embodiments, the step S24 may be regarded as an overmolding step.

A further step S26 may follow which may include removing the at least one slide, if any, from the cavity of the mold. Consequently, the guide slot formed at the stationary blade may be cleared. The guide slot may provide for a defined mating for a to-be-mounted movable cutter blade at the stationary blade.

A further step S28 may follow which may be regarded as an optional step. The step S28 may include separating single stationary blades from an array or row including a plurality of stationary blades formed in a mold comprising a plurality of respective molding cavities.

Figure 27:
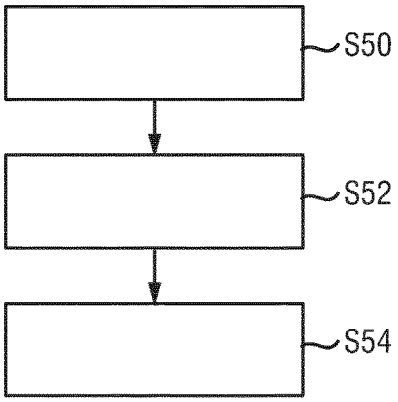
FIG. 27 illustrates a further illustrative block diagram representing several steps of an embodiment of an exemplary method of manufacturing a movable cutter blade in accordance with several aspects of the present disclosure.

FIG. 27 illustrates an exemplary manufacturing method for a movable cutter blade that may be configured to cooperate with a stationary blade formed and arranged in accordance with at least some aspects of the present disclosure. At a step S50, a precursor for the movable cutter blade or a semi-finished movable cutter blade may be provided. This may involve providing sheet metal material which may comprise a predefined row or array of a plurality of to-be-processed movable cutter blades. A further S52 may follow which may include forming or processing toothed leading edges of the movable cutter blade. The step S52 may further include processing relatively sharp cutting edges at respective teeth of the toothed leading edge. The step S52 may include adequate material-removing processors. By way of example, the step S52 may include an integrated etching step comprising forming a general toothed shape at the toothed leading edge, and forming relatively sharp cutting edges at the teeth. A further step S54 may follow which may include separating respective movable cutter blades from a supporting structure including a row or an array of a plurality of movable cutter blades.

Figure 28:
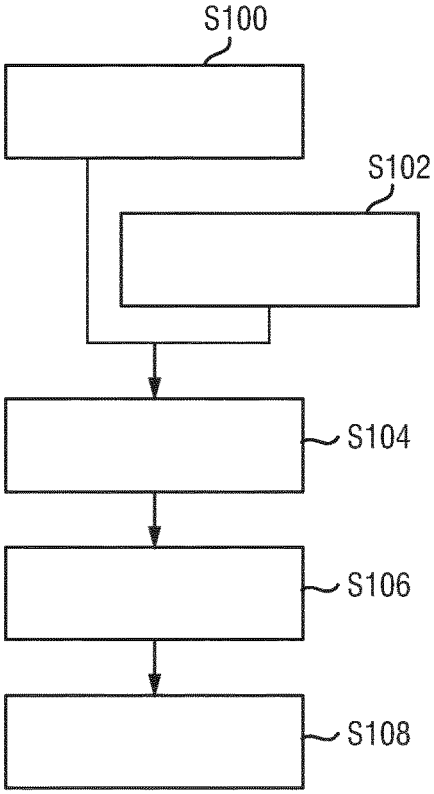
FIG. 28 shows a further illustrative block diagram representing several steps of an embodiment of an exemplary method of manufacturing a blade set in accordance with several aspects of the present disclosure.

FIG. 28 illustrates an exemplary manufacturing method for a blade set including a stationary blade and a movable cutter blade formed in accordance with at least some aspects of the present disclosure. The method may include a step S100 comprising providing a stationary blade. The stationary blade may be formed in accordance with the exemplary manufacturing method illustrated in FIG. 26. A further step S102 may include providing a movable cutter blade. The steps S100 and S102 may take place in parallel. The step S102 may comprise manufacturing the movable cutter blade in accordance with the method illustrated in FIG. 27. A joining or mating step S104 may follow in which the movable cutter blade is inserted into a guide slot at the stationary blade. Inserting the movable cutter blade into the guide slot of the stationary blade may involve laterally inserting the movable cutter blade through a lateral opening of the stationary blade.

A further step S106 may follow which may involve feeding a transmitting member 70 to the semi-finished assembly of the blade set. The step S106 may particularly involve feeding the transmitting member 70 in a feeding direction that is different from an insertion direction of the movable cutter blade. A further step S108 may follow which includes attaching the transmitting member 70 to the movable cutter blade 24. The step S108 may further include bonding the transmitting member to the movable cutter blade. Bonding may involve welding, particularly laser welding. Attaching the movable cutter blade and the transmitting member while both elements are positioned at the stationary blade may lock the movable cutter blade at the stationary blade. This may be particularly beneficial since in this way no separate fastening or locking components for the movable cutter blade are required.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A stationary blade for a blade set of a hair cutting appliance, said blade set being arranged to be moved through hair in a moving direction to cut hair, said stationary blade comprising:

a first wall portion arranged to serve as a skin facing wall when in operation, a second wall portion at least partially offset from the first wall portion, such that the first wall portion and the second wall portion define therebetween a guide slot arranged to receive a movable cutter blade, at least one toothed leading edge jointly formed by the first wall portion and the second wall portion, wherein the at least one toothed leading edge comprises a plurality of teeth, wherein the first wall portion and the second wall portion are connected at a frontal end of the at least one leading edge, thereby forming tips of the teeth, wherein the stationary blade is an integrally formed metal-plastic composite stationary blade, wherein the first wall portion is at least partially made from metal material, and wherein the second wall portion is at least partially made from plastic material.

2. The stationary blade as claimed in claim 1, comprising a metal component, particularly a sheet metal insert, and a plastic component bonded to the metal component, wherein at least a central portion of the first wall portion.

3. The stationary blade as claimed in claim 2, wherein the metal component further comprises tooth stem portions comprising cutting edges that are configured to cooperate with cutting edges of respective teeth of the movable cutter blade to cut hairs that are trapped therebetween when in operation.

4. The stationary blade as claimed in claim 2, wherein the metal component comprises at least one anchoring element, particularly at least one positive-fit anchoring element extending from a respective tooth stem portion, wherein the plastic component and the metal component are connected at the at least one anchoring element.

5. The stationary blade as claimed in claim 4, wherein the at least one anchoring element is inclined with respect to a top surface of the first wall portion, particularly rearwardly bended.

6. The stationary blade as claimed in claim 4, wherein the at least one anchoring element is T-shaped, U-shaped or O-shaped, particularly when viewed from the top.

7. The stationary blade as claimed in claim 4, wherein the at least one anchoring element is rearwardly offset from a top surface of the first wall portion.

8. The stationary blade as claimed in claim 4, wherein the tips of the teeth are formed by the plastic component, wherein the plastic component further engages the positive-fit anchoring elements at a bonding area between the tooth stem portions of the metal component and the tips of the teeth.

9. The stationary blade as claimed in claim 2, wherein the plastic component and the metal component form an integrally formed part selected from the group consisting of insert-molded part, outsert-molded part and overmolded part.

10. The stationary blade as claimed in claim 1, wherein the teeth of the at least one toothed leading edge comprise, when viewed in a cross-sectional plane perpendicular to the lateral direction (Y), a substantially U-shaped form comprising a first leg at the first wall portion and a second leg at the second wall portion, wherein the first leg and the second leg merge into one another at the tooth tips.

11. A blade set for a hair cutting appliance, said blade set being arranged to be moved through hair in a moving direction to cut hair, said blade set comprising:

a stationary blade as claimed in claim 1, and a movable cutter blade comprising at least one toothed leading edge, said movable cutter blade being movably arranged within the guide slot defined by the stationary blade, such that, upon relative motion between the movable cutter blade and the stationary blade, the at least one toothed leading edge of the movable cutter blade cooperates with corresponding teeth of the stationary blade to enable cutting of hair caught therebetween in a cutting action.

12. A method of manufacturing a metal-plastic composite stationary blade of a blade set for a hair cutting appliance, comprising the following steps:

providing a metal component, particularly a sheet metal component, at least substantially forming a central portion of a first wall portion, providing a mold, particularly an injection mold, the mold defining a shape of a plastic component, arranging the metal component in the mold, providing a substitute component in the mold, the substitute component being configured to keep clear a to-be-formed guide slot of the stationary blade when molding, forming, particularly injection molding, the plastic component, wherein the plastic component and the metal component define a first wall portion and a second wall portion, the first wall portion being arranged to serve as a skin facing wall when in operation, the second wall portion being at least partially offset from the first wall portion, such that the first wall portion and the second wall portion define therebetween the guide slot for a movable cutting blade, wherein the first wall portion and the second wall portion jointly form at least one toothed leading edge comprising a plurality of teeth, and wherein the first wall portion and the second wall portion are connected at a frontal end of the at least one leading edge, thereby forming tips of the teeth, and removing the substitute component from the metal-plastic composite stationary blade.

13. The method as claimed in claim 12, wherein the step of providing the substitute component in the mold comprises at least one of the following steps:

providing at least one lateral slide in the mold that defines the guide slot for the movable cutter blade, and arranging a separate replacement dummy component in the mold, particularly a reusable dummy component, wherein the dummy component is removed from the metal-plastic composite stationary blade outside the mold.

14. The method as claimed in claim 12, further comprising:

machining the metal component, wherein machining the metal component comprises at least one of forming tooth stem portions and forming anchoring elements at the metal component, and wherein the step of machining the metal component further comprises at least one process selected from the group consisting of:

cutting, particularly laser cutting, etching, particularly electrochemical etching, stamping, coining, eroding, particularly wire-eroding, and combinations thereof.

15. A method of manufacturing a blade set for a hair cutting appliance, comprising the following steps:

manufacturing a stationary blade in accordance with the method as claimed in claim 12, providing a movable cutter blade comprising at least one toothed leading edge arranged to cooperate with at least one respective toothed leading edge of the stationary blade; and inserting the movable cutter blade into the guide slot of the stationary blade, particularly feeding the movable cutting blade through a lateral opening of the stationary blade.

* * * * *